US012618243B2

(12) United States Patent
Pina et al.

(10) Patent No.: US 12,618,243 B2
(45) Date of Patent: May 5, 2026

(54) SIDING ATTACHMENT ACCESSORY AND SIDING SYSTEM

(71) Applicant: CertainTeed LLC, Malvern, PA (US)

(72) Inventors: Kyle Pina, Newton, MA (US); Dennis Michaud, Groton, CT (US); Keyan Hansen, Northboro, MA (US); Andy Hojoa, Northboro, MA (US); Jonathan Knowles, Northboro, MA (US); William Lentlie, Worcester, MA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 18/582,022

(22) Filed: Feb. 20, 2024

(65) Prior Publication Data

US 2024/0318434 A1 Sep. 26, 2024

Related U.S. Application Data

(63) Continuation of application No. 17/148,062, filed on Jan. 13, 2021, now Pat. No. 11,905,715.

(60) Provisional application No. 62/961,454, filed on Jan. 15, 2020.

(51) Int. Cl.
*E04B 1/76* (2006.01)
*E04F 13/08* (2006.01)

(52) U.S. Cl.
CPC ..... *E04F 13/0848* (2013.01); *E04B 1/762* (2013.01)

(58) Field of Classification Search
CPC ..... E04B 1/762; E04F 13/0848; A47F 5/006; A47F 5/0823; A47F 5/0815; A47F 5/0846; A47F 5/0853; Y10T 24/344; F16M 11/04; F16M 13/02; F16M 13/022
USPC ..... 52/806.05; 211/57.1, 59.1, 94.01
See application file for complete search history.

(56) References Cited

U.S. PATENT DOCUMENTS

| | | | | |
|---|---|---|---|---|
| 2,200,649 | A | 5/1940 | Wardle | |
| 3,828,510 | A | 8/1974 | Bettoli | |
| 3,894,706 | A | 7/1975 | Mizusawa | |
| 3,903,670 | A | 9/1975 | Robinson, Jr. | |
| D264,682 | S | 6/1982 | Van Doren | |
| 4,435,938 | A * | 3/1984 | Rutkowski | E04F 13/0864 52/546 |
| 5,067,677 | A | 11/1991 | Miceli | |
| 5,090,645 | A | 2/1992 | Zuercher | |
| D326,999 | S | 6/1992 | Johnson | |
| D365,007 | S | 12/1995 | Sheftel | |

(Continued)

FOREIGN PATENT DOCUMENTS

| | | | |
|---|---|---|---|
| CA | 1174027 | A | 9/1984 |
| FI | 90452 | C | 2/1994 |

*Primary Examiner* — James J Buckle, Jr.
(74) *Attorney, Agent, or Firm* — McDonnell Boehnen Hulbert & Berghoff LLP

(57) ABSTRACT

The present disclosure relates generally to siding, for example, suitable for use covering the exterior surface of a building. The present disclosure relates more particularly to a siding attachment accessory including an attachment platform having a front face and a rear face. The attachment accessory also includes at least one siding hanger extending forward from the front face of the attachment platform that is configured to hold a siding component. Each siding hanger of the attachment accessory includes a retaining arm having a proximal end attached to the front face of the attachment platform and a distal end spaced from the attachment platform.

20 Claims, 23 Drawing Sheets

(56) References Cited

U.S. PATENT DOCUMENTS

| | | | | |
|---|---|---|---|---|
| 5,622,020 | A | 4/1997 | Wood | |
| 5,639,049 | A | 6/1997 | Jennings | |
| 6,315,489 | B1 | 11/2001 | Watanabe | |
| 6,367,220 | B1 | 4/2002 | Krause | |
| 6,402,419 | B1 | 6/2002 | Watanabe | |
| 6,499,261 | B2 | 12/2002 | Hikai | |
| 6,598,362 | B2 | 7/2003 | Hikai | |
| 6,609,342 | B2 | 8/2003 | Hikai | |
| 6,637,170 | B2 | 10/2003 | Ito | |
| 6,655,099 | B1 | 12/2003 | Trenoweth | |
| 6,830,405 | B2 | 12/2004 | Watanabe | |
| 7,131,170 | B2 | 11/2006 | Weaver | |
| 7,201,355 | B1 | 4/2007 | Zien | |
| 7,581,364 | B2 | 9/2009 | Godby | |
| 7,608,782 | B2 | 10/2009 | Hill | |
| 7,748,188 | B2 | 7/2010 | Ito | |
| 7,823,853 | B2 | 11/2010 | Larson | |
| D677,097 | S | 3/2013 | Page | |
| 8,429,868 | B2 | 4/2013 | Minami | |
| 8,979,052 | B2 | 3/2015 | Uota | |
| 9,091,078 | B2 | 7/2015 | Deschênes | |
| D755,043 | S | 5/2016 | Bailey | |
| 9,856,655 | B2 | 1/2018 | Knight | |
| 9,926,707 | B1 | 3/2018 | Knight, Jr. | |
| 10,753,099 | B2 * | 8/2020 | O'Neal | E04F 13/0876 |
| 10,797,477 | B1 | 10/2020 | Peterson | |
| D922,186 | S | 6/2021 | Schneider | |
| 2002/0046536 | A1 | 4/2002 | Hotta | |
| 2006/0117694 | A1 | 6/2006 | Godby | |
| 2006/0213142 | A1 | 9/2006 | Albracht | |
| 2007/0107357 | A1 | 5/2007 | O'Neal | |
| 2007/0144096 | A1 * | 6/2007 | O'Neal | E04F 13/0864 52/549 |
| 2009/0000244 | A1 * | 1/2009 | O'Neal | E04F 13/0864 52/762 |
| 2011/0289872 | A1 | 12/2011 | Hiscock | |
| 2020/0087922 | A1 | 3/2020 | Kotiadis | |
| 2020/0399884 | A1 * | 12/2020 | Schneider | E04F 15/02044 |

* cited by examiner

SIDING ATTACHMENT ACCESSORY AND SIDING SYSTEM

CROSS-REFERENCE TO RELATED APPLICATIONS

This application is a continuation of U.S. patent application Ser. No. 17/148,062, filed Jan. 13, 2021, which claims the benefit of priority of U.S. Provisional Patent Application No. 62/961,454, filed Jan. 15, 2020, each of which is hereby incorporated herein by reference in its entirety.

BACKGROUND OF THE DISCLOSURE

1. Field of the Disclosure

The present disclosure relates generally to siding, for example, suitable for use covering the exterior surface of a building. The present disclosure relates more particularly to an attachment accessory for securing siding to a support surface, such as an exterior sheathing or wall framing.

2. Technical Background

Building surface panels, such as siding, are visible elements that cover an underlying support structure. Siding panels are typically used in the construction of homes, businesses, and other buildings on exterior walls. The siding panels provide both an aesthetic element to cover functional layers of the underlying wall structure as well as protection from weather and other elements.

Most siding panels expand and contract with changes in temperature, similar to many construction materials. In particular, siding panels may expand as the weather warms during summer months and contract as the weather cools during winter months. Due to the elongated shape of most siding panels, the length of the panels can vary with temperature more than a negligible amount. To accommodate this expansion and contraction, many siding panels are installed using mechanical fasteners that pass through slots in a fastening strip of the siding panel. The slots are oriented in the same direction as the length of the siding panel so that the siding panel is able to move back and forth over the fastener. Accordingly, this flexible attachment method does not hinder the expansion and contraction of the siding panel with changes in temperature.

In order to utilize the foregoing flexibility provided by the slots in the siding panel fastening strip, the mechanical fasteners are installed by hand to an appropriate depth that will be secure without hindering lateral movement of the siding panel over the mechanical fastener. If the mechanical fastener is inserted too far, it will pin the panel against the underlying support structure and prevent lateral movement of the panel with expansion and contraction. Most siding installations require the use of many mechanical fasteners to attach siding panels that cover an entire exterior surface. The process of installing each mechanical fastener by hand is slow and, therefore, costly. The present inventors have determined that a system allowing for faster and easier installation of siding and siding components would be attractive to builders and customers.

SUMMARY OF THE DISCLOSURE

In one aspect, the present disclosure provides a siding attachment accessory comprising:

- an attachment platform including a front face and a rear face;
- at least one siding hanger extending forward from the front face of the attachment platform and configured to hold a siding component, each siding hanger including a retaining arm having a proximal end attached to the front face of the attachment platform and a distal end spaced from the attachment platform; and
- a plurality of support legs extending rearward from the rear face of the attachment platform.

In another aspect, the present disclosure provides a siding attachment accessory comprising:

- an attachment platform including a front face and a rear face; and
- at least one siding hanger extending forward from the front face of the attachment platform and configured to hold a siding component, each siding hanger including:
  - a retaining arm having a proximal end attached to the front face of the attachment platform and a distal end spaced from the attachment platform, and
  - an overhang disposed over the retaining arm, the overhang having a proximal end attached to the front face of the attachment platform and a distal end spaced from the attachment platform,
  - wherein the retaining arm is configured as a hook and the distal end curves toward the overhang.

In another aspect, the present disclosure provides a siding attachment accessory comprising:

- an attachment platform including a front face and a rear face; and
- at least one siding hanger extending forward from the front face of the attachment platform and configured to hold a siding component, each siding hanger including:
  - a retaining arm having a proximal end attached to the front face of the attachment platform and a distal end spaced from the attachment platform, wherein the retaining arm includes a pair of prongs that are configured to snap into an aperture in the siding component.

In another aspect, the present disclosure provides a building surface siding system comprising:

- a support structure;
- a first siding attachment accessory according to the disclosure attached to the support structure; and
- a first siding panel including a panel body, a first lock disposed along a first edge of the panel body, a second lock disposed along a second edge of the panel body, and a fastening strip coupled to the first lock, the fastening strip including apertures therethrough,
- wherein the retaining arm of each of the siding hangers of the first siding attachment accessory extends through an aperture of the fastening strip of the first siding panel so as to secure the first siding panel to the support structure.

In another aspect, the present disclosure provides a method of constructing a building surface siding system according to the disclosure, the method comprising:

- securing the first siding panel to the support structure using the first siding attachment accessory such that the retaining arm of each of the siding hangers of the first siding attachment accessory extends through an aperture of the fastening strip of the first siding panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional methods of installing siding are slow and costly. The present inventors have determined that a system allowing for faster and easier installation of siding and siding components would be attractive to builders and customers.

Accordingly, one aspect of the disclosure is a siding attachment accessory configured to secure a siding panel to a support structure, such as an exterior surface of a building. The siding attachment accessory includes an attachment platform having a front face and a rear face, at least one siding hanger configured to hold a siding component, and a plurality of support legs extending rearward from the rear face of the attachment platform. Each siding hanger extends forward from the front face of the attachment platform and includes a retaining arm having a proximal end attached to the front face of the attachment platform and a distal end spaced from the attachment platform.

Figure 1:
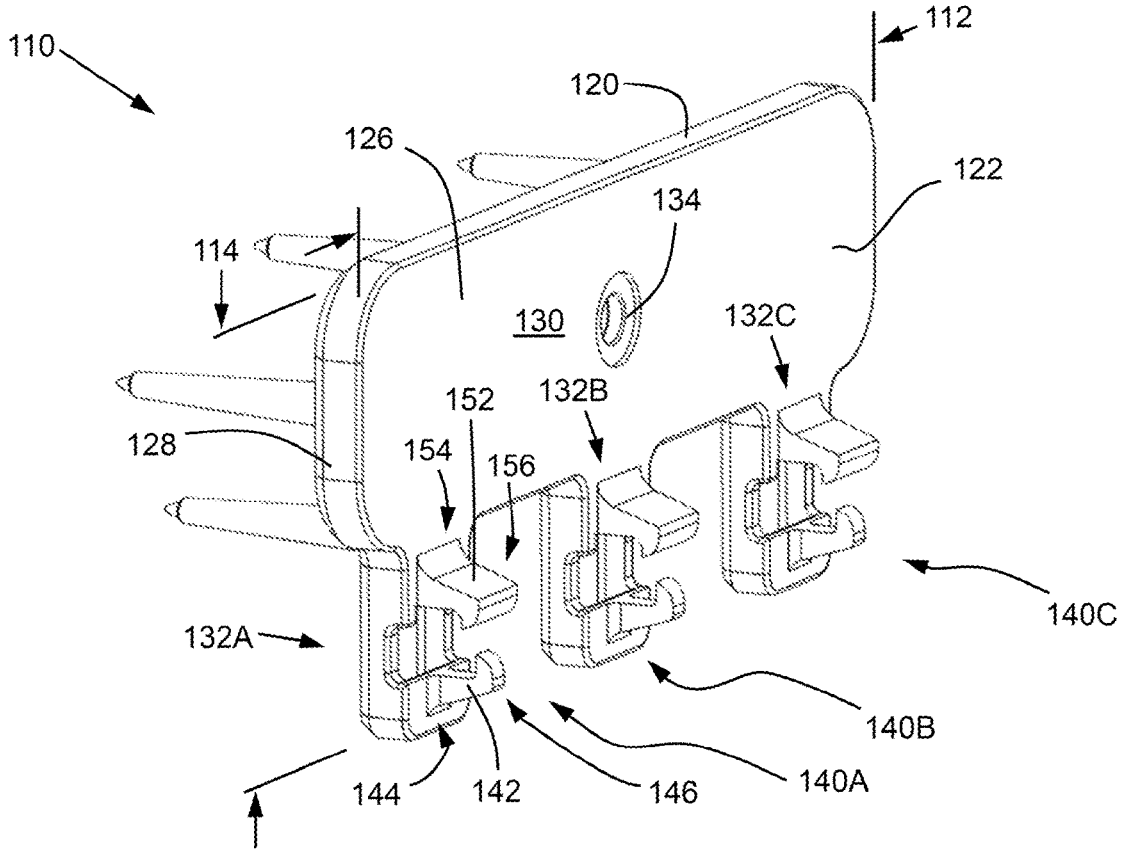
FIG. 1 is a schematic perspective front view of a siding attachment accessory according to an embodiment of the disclosure.
Figure 2:
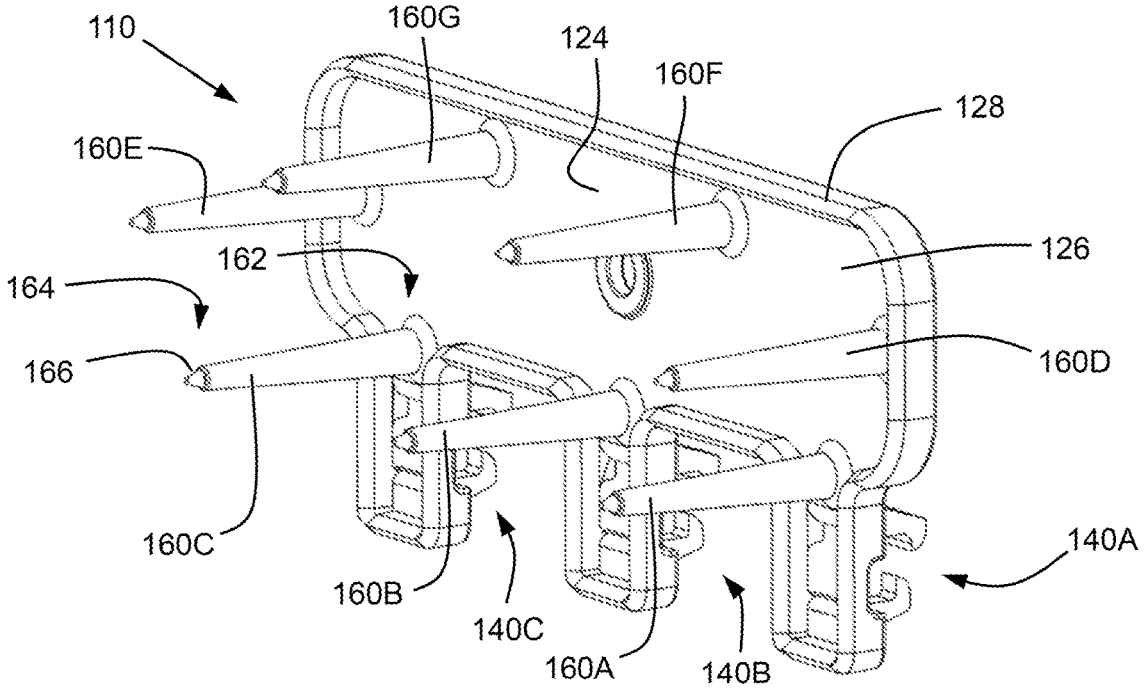
FIG. 2 is a schematic perspective rear view of the siding attachment accessory of FIG. 1.

Such a siding attachment accessory is shown in front and rear perspective views in FIGS. 1 and 2. Siding attachment accessory 110 includes an attachment platform 120, three siding hangers 140A-140C and a plurality of support legs 160A-160G. Siding attachment accessory 110 includes a width 112 and a height 114, which are defined by the direction of extension of the attachment platform 120. Attachment platform 120 includes a front face 122 and a rear face 124, and is formed by a planar plate 126 surrounded by a perimeter frame 128. The perimeter frame 128 is bent with respect to the plane of plate 126, as shown in FIG. 2, so as to provide structural support to attachment platform 120. The three siding hangers 140A, 140B, 140C of siding attachment accessory 110 extend forward from front face 122 of attachment platform 120. As illustrated with respect to siding hanger 140A, each of the siding hangers includes a retaining arm 142 having a proximal end 144 attached to the front face 122 of attachment platform 120 and a distal end 146 spaced from attachment platform 120.

In order to secure a siding component, such as a siding panel or siding accessory, to siding attachment accessory 110, the distal end 146 of each siding hanger 140A-140C is inserted through an aperture of the siding component. The siding component is then pushed toward attachment platform 120 such each retaining arm 142 extends entirely through the aperture(s) and the siding component is securely held onto the siding hanger. In some embodiments, each retaining arm extends through a respective aperture in the siding component, in other embodiments more than one of the retaining arm extends through an aperture in the siding component. For example, in some embodiments, two or more retaining arms of the siding attachment accessory extend through a single aperture in the siding component.

The plurality of support legs 160A-160G of siding attachment accessory 110 extend rearward from rear face 124 of attachment platform 120. Support legs 160A-160G are configured to hold attachment platform 120 at a distance from the support structure that siding attachment accessory 110 is secured to. Such a gap between the attachment platform 120 and the support structure allows the inclusion of a layer of insulation between the support structure the siding component that is secured thereto. Further, the use of the siding attachment accessories of the disclosure to secure siding components over the insulation provides reduced thermal bridges between support structure and the exterior surface, as conventional methods have larger structural components between the support structure and the siding.

Figure 3A:
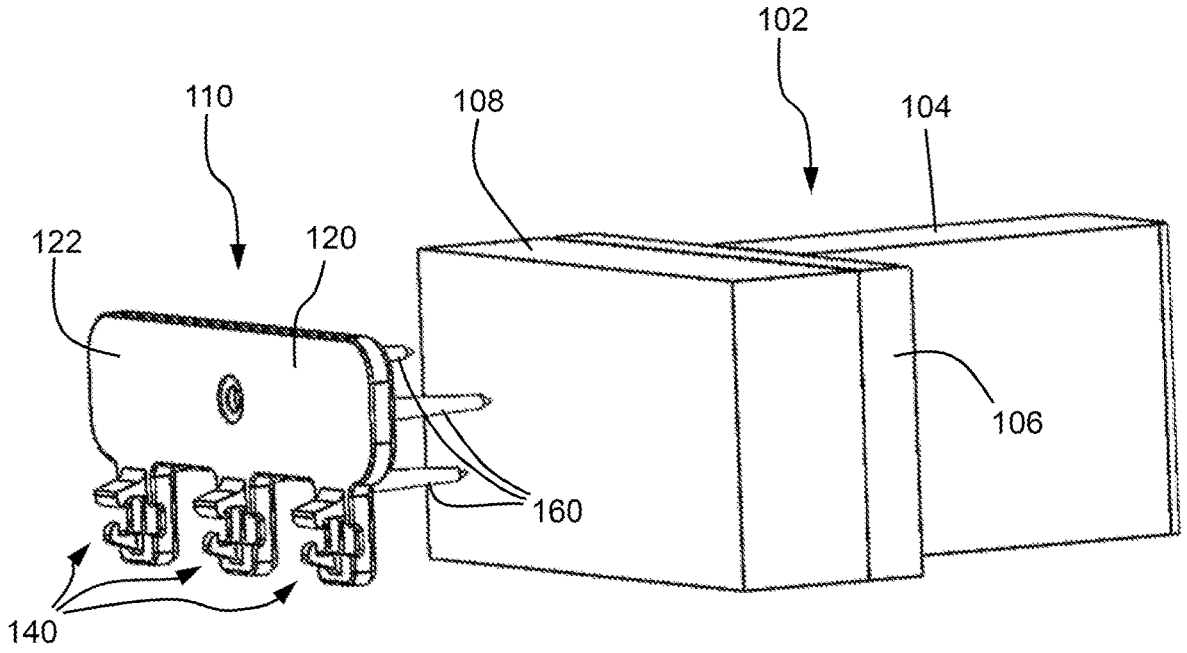
FIG. 3A is a schematic perspective view of the siding attachment accessory of FIG. 1 during installation onto a support structure in accordance with an embodiment of the disclosure.

FIGS. 3A-3D illustrate the use of support legs 160 during the securing of siding attachment accessory 110 to a support structure 102. FIG. 3A shows siding attachment accessory 110 disposed over a small section of a support structure 102. Support structure 102 includes a framing element 104, such as a joist, that is covered by an exterior sheathing 106. A layer of insulation 108 is likewise positioned on a front surface of the exterior sheathing 106. Siding attachment accessory 110 is positioned with support legs 160 facing the support structure while front face 122 of attachment platform 120 and siding hangers 140 face away from support structure 102.

Figure 3B:
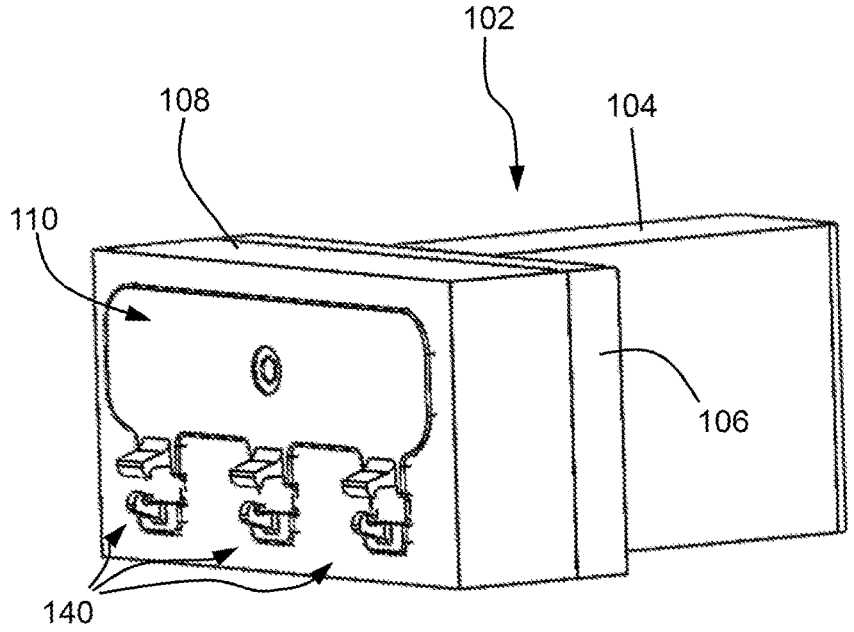
FIG. 3B is another schematic perspective view of the siding attachment accessory of FIG. 1 during installation onto the support structure in accordance with the embodiment of FIG. 3A.

As shown in FIG. 3B, the siding attachment accessory 110 is pushed toward support structure 102 so that support legs 160 are inserted through the insulation 108 until the distal ends of support legs 160 contact exterior sheathing 106. In some embodiments, the insulation is a non-rigid insulation, such as a fibrous insulation, so that the support legs can penetrate the insulation and reach the support structure.

Figure 3C:
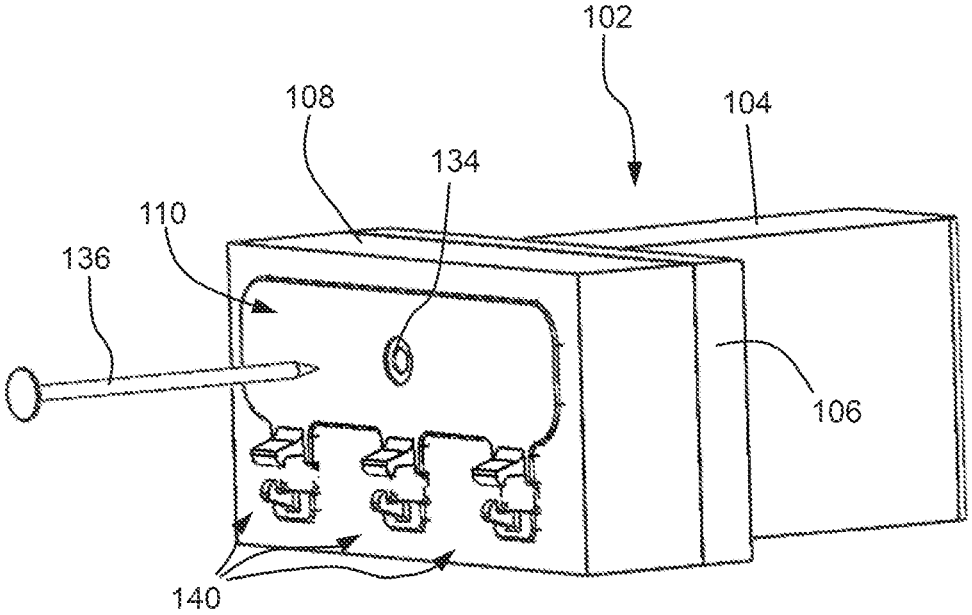
FIG. 3C is another schematic perspective view of the siding attachment accessory of FIG. 1 during installation onto the support structure in accordance with the embodiment of FIG. 3A.
Figure 3D:
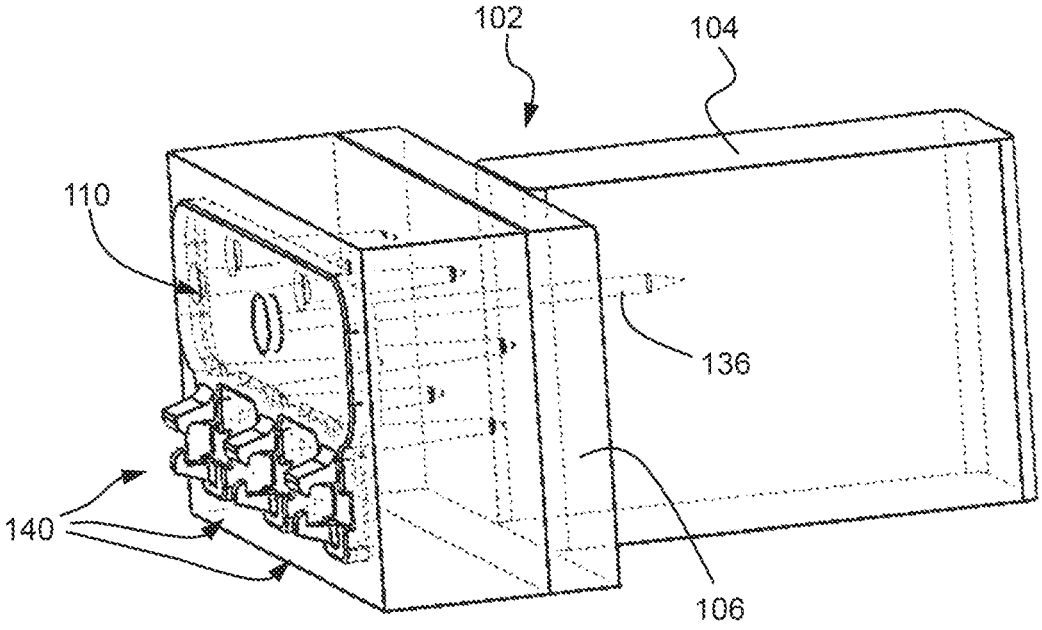
FIG. 3D is another schematic perspective view of the siding attachment accessory of FIG. 1 during installation onto the support structure in accordance with the embodiment of FIG. 3A.

As shown in FIGS. 3C and 3D, a mechanical fastener 136 is inserted through an aperture 134 in the attachment platform 120 of siding attachment accessory 110. Mechanical fastener 136 extends through insulation 108 and is inserted into support structure 102. While mechanical fastener 136 is driven through exterior sheathing 106 and into framing element 104, in other embodiments, the mechanical fastener is driven only through the exterior sheathing without engaging a framing element.

In certain embodiments of the siding attachment accessory as otherwise described herein, at least three of the support legs are disposed in a non-linear arrangement so as to support the attachment platform. For example, in some embodiments, at least three of the support legs are disposed in a triangular configuration to provide support of the attachment platform and prevent tilting or rocking of the siding attachment accessory. For example, as shown in FIG. 2, siding attachment accessory 110 includes seven support legs 160A-160D and many of the support legs are arranged in triangular configurations. For example, the two upper support legs 160F and 160G are arranged in a triangular configuration with the lower central support leg 160B at the center of siding attachment accessory 110. Likewise, support legs 160B and 160F are arranged in a triangular configuration with one of the lower side legs 160A. This triangular configuration of support legs 160A, 160B and 160F provides a secure support of one side of siding attachment accessory 110 preventing collapse of the attachment platform 120 on the corresponding side of the accessory. Likewise, a triangular configuration of the support legs on the opposing side of the accessory provides similar support. By placing the support legs in a triangular configuration, rather than a linear configuration, the attachment platform may be supported in all direction.

In other embodiments, the plurality of support legs are disposed in a linear arrangement. In such embodiments the support legs position the attachment platform at a distance from the support structure and the back of the attachment platform, such as the rear face or the perimeter frame, may contact any insulation that covers the support structure. For example, in some embodiments the plurality of support legs consists of two support legs that extend from the rear face of the attachment platform and are configured to hold the attachment platform and siding hangers at a distance from an underlying support structure.

In certain embodiments, the support legs also assist in securing the insulation in place. For example, in some embodiments, because the support legs penetrate through the layer of insulation, the support legs provide a plurality of anchor points for the insulation, which helps hold the insulation in place. In particular, in some embodiments, the insulation is held to the support structure using the support legs of one or more siding attachment accessories.

In certain embodiments of the siding attachment accessory as otherwise described herein, a respective one of the plurality of support legs is disposed behind each siding hanger. For example, each of siding hangers 140A, 140B, 140C of siding attachment accessory 110 is disposed in front of a respective support leg 160A, 160B, 160C. The use of a support leg behind each siding hanger provides support for the attachment platform at locations where the loads on the siding attachment accessory may be highest. For example, with a siding panel secured to the siding hangers, wind and other loads on the siding panel may be transferred to the siding attachment accessory via the siding hangers. The respective support legs may then provide direct support to the respective siding hangers that hold the siding panel. In other embodiments, the position of the support legs is independent of the siding hangers. For example, in some embodiments, the support legs are provided at the outer edges of the attachment platform.

In certain embodiments of the siding attachment accessory as otherwise described herein, each support leg extends a distance of at least 0.5 inches from the rear face of the attachment platform, e.g., at least 0.75 inches, e.g., at least 1 inch. Further, in some embodiments, each support leg extends a distance of no more than 5.5 inches from the rear face of the attachment platform, e.g., no more than 5 inches, e.g., no more than 4 inches, e.g., no more than 3 inches, e.g., no more than 2.5 inches. For example, in some embodiments each support leg has a length in a range from 0.5 inches to 5.5 inches, e.g., from 0.75 inches to 5 inches, e.g., from 1 inch to 4 inches, e.g., from 1 inch to 3 inches, e.g., from 1 inch to 2.5 inches, or from 0.5 inches to 2.5 inches.

In certain embodiments of the siding attachment accessory as otherwise described herein, each leg tapers inward from the attachment platform to a pointed tip. For example, as illustrated with respect to support leg 160C in FIG. 2, each leg includes a proximal end 162 attached to the rear face 124 of attachment platform 120 and a distal end 164 opposite thereof. The support legs taper inward from proximal end 162 to distal end 164 which is the form a pointed tip 166.

In certain embodiments of the siding attachment accessory as otherwise described herein, the pointed tip is configured to penetrate a support structure. For example, as illustrated in FIGS. 3A and 3B, once the support legs 160 of siding attachment accessory 110 are inserted through insulation 108, they each contact exterior sheathing 106. With further pressure of siding attachment accessory 110 against support structure 102, the pointed tips 166 may penetrate the exterior sheathing 106 and form indentations therein. These small indentations provided added support of the siding attachment accessory 110 by hindering lateral movement of the support legs 160 against the exterior sheathing 106.

Further, in some embodiments, pointed tips of the support legs are configured to penetrate the support structure so as to attach the siding attachment accessory to the support structure. For example, in some embodiments, each of the support legs acts as a mechanical fastener for anchoring the siding attachment accessory to the support structure. Accordingly, in some embodiments, the siding attachment accessory is secured to the support structure by driving the support legs into the support structure, either with or without the use of an additional mechanical fastener.

In certain embodiments of the siding attachment accessory as otherwise described herein, the pointed tip is configured to deform upon contacting a support surface. For example, in some embodiments the pointed tip at the distal end of each of the support legs is configured to crumple upon being forced against a support surface. Accordingly, the siding attachment accessory may be pressed against the support surface until each of the support legs is in contact with and braced by the support surface, even if the support surface is uneven.

Figure 4:
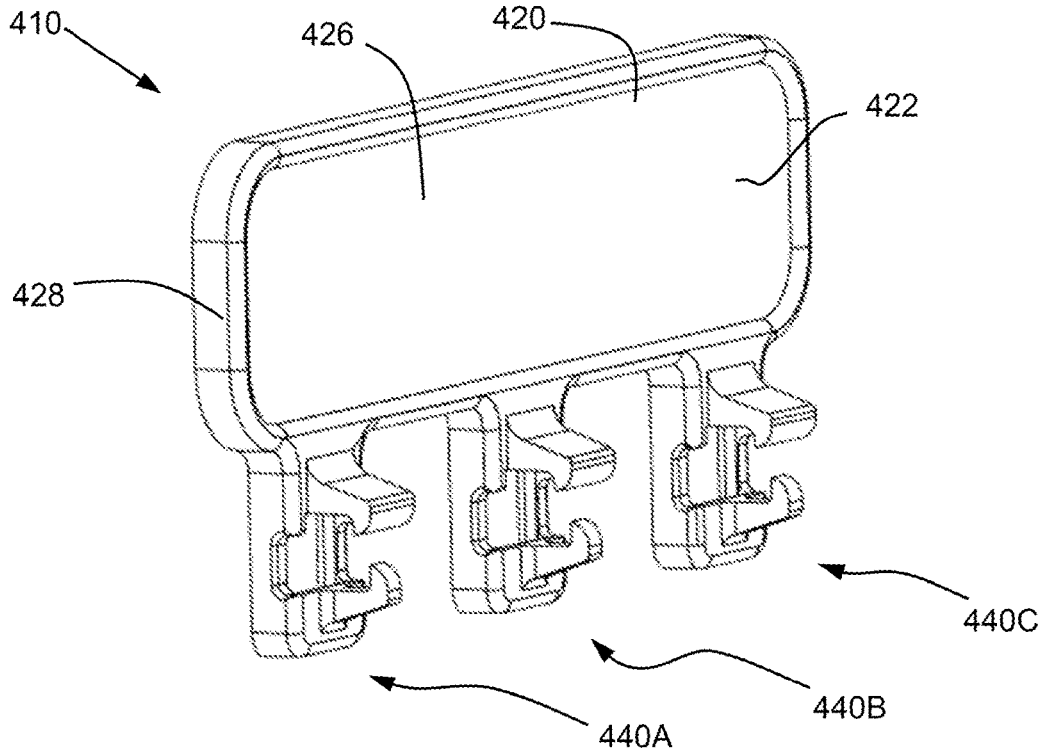
FIG. 4 is a schematic perspective front view of a siding attachment accessory according to an embodiment of the disclosure.
Figure 5:
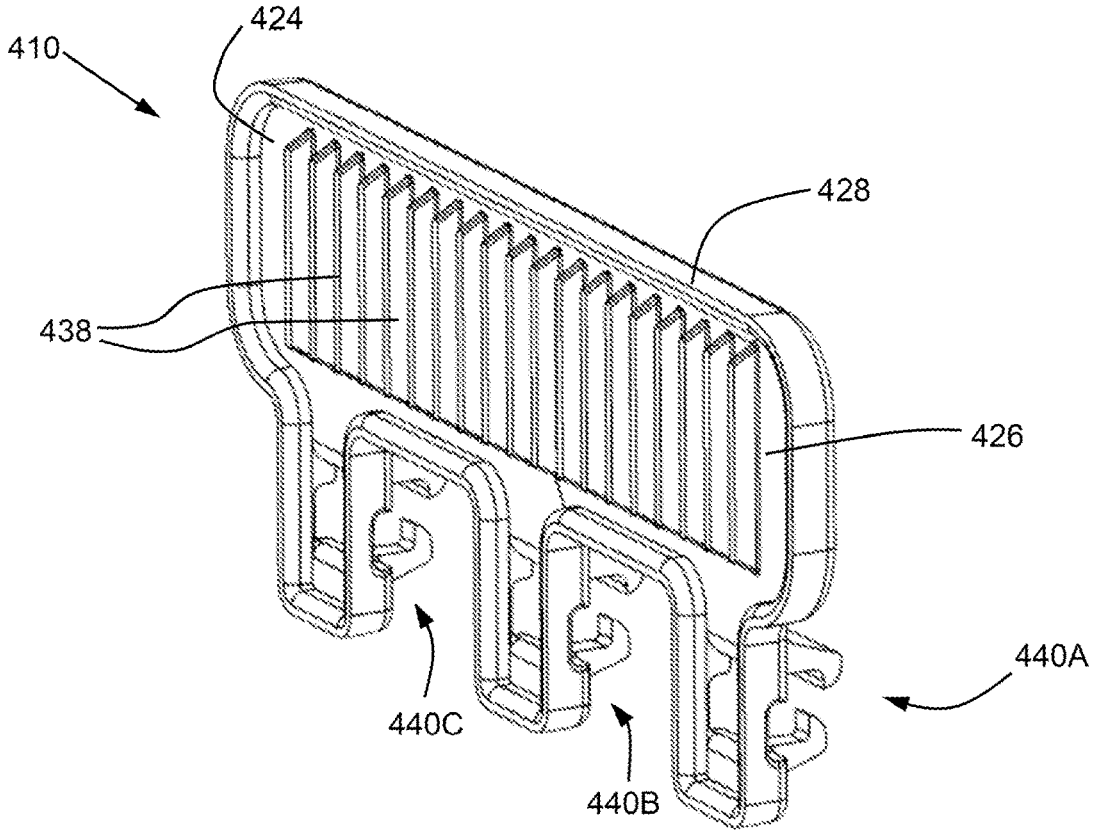
FIG. 5 is a schematic perspective rear view of the siding attachment accessory of FIG. 4.

In some embodiments, the siding attachment accessory is provided without any support legs. Accordingly, in such embodiments, the siding attachment accessory is configured such that the rear surface of the attachment platform is secured directly against the support structure. Such a siding attachment accessory is shown in FIGS. 4 and 5. Siding attachment accessory 410 includes an attachment platform 420 including a front face 422 and a rear face 424. The attachment platform 420 is formed by a planar plate 426 surrounded by a perimeter frame 428. Siding attachment accessory 410 also includes three siding hangers 440A, 440B, 440C that extend forward from front face 422 of attachment platform 420. As illustrated, siding hangers 440A-440C have the same configuration as those of siding attachment accessory 110. However, in other embodiments, the siding hangers have a different configuration, as explained below.

Instead of support legs, the rear face 424 of attachment platform 420 includes strengthening ribs 438 that along the height of the siding attachment accessory 410. The strengthening ribs 438 add structural strength to the attachment platform 420, similar to perimeter frame 428. In other embodiments, the rear face of the attachment platform is simply flat, including neither support legs nor strengthening ribs.

In certain embodiments of the siding attachment accessory as otherwise described herein, each siding hanger further includes an overhang disposed over the retaining arm, where the overhang has a proximal end attached to the front face of the attachment platform and a distal end spaced from the attachment platform, and where the retaining arm is configured as a hook and the distal end curves toward the overhang. For example, each of siding hangers 140A-140C of siding attachment accessory 110 includes an overhang 152 disposed over the respective retaining arm 142, as illustrated with respect to siding hanger 140A. Overhang 152 includes a proximal end 154 that extends from front face 122 of attachment platform 120 and a distal end 156 opposite the proximal end 154. Further, retaining arm 142 is configured as a hook such that the distal end 146 curves toward overhang 152. This configuration provides a secure attachment of a siding component on the siding hanger. The hooked shape of the distal end of the retaining arm prevents inadvertent removal of the retaining arm from an aperture in the siding component. Likewise, the overhang prevents the siding component from easily rising up over the hooked distal end of the retaining arm.

As mentioned previously, the siding hangers 440 of siding attachment accessory 410 have a similar configuration as siding hangers 140 of siding attachment accessory 110, where the siding hangers 440 also each include a retaining arm with a hooked distal end and an overhang over the retaining arm. In other embodiments, the siding hangers have another configuration.

Figure 6:
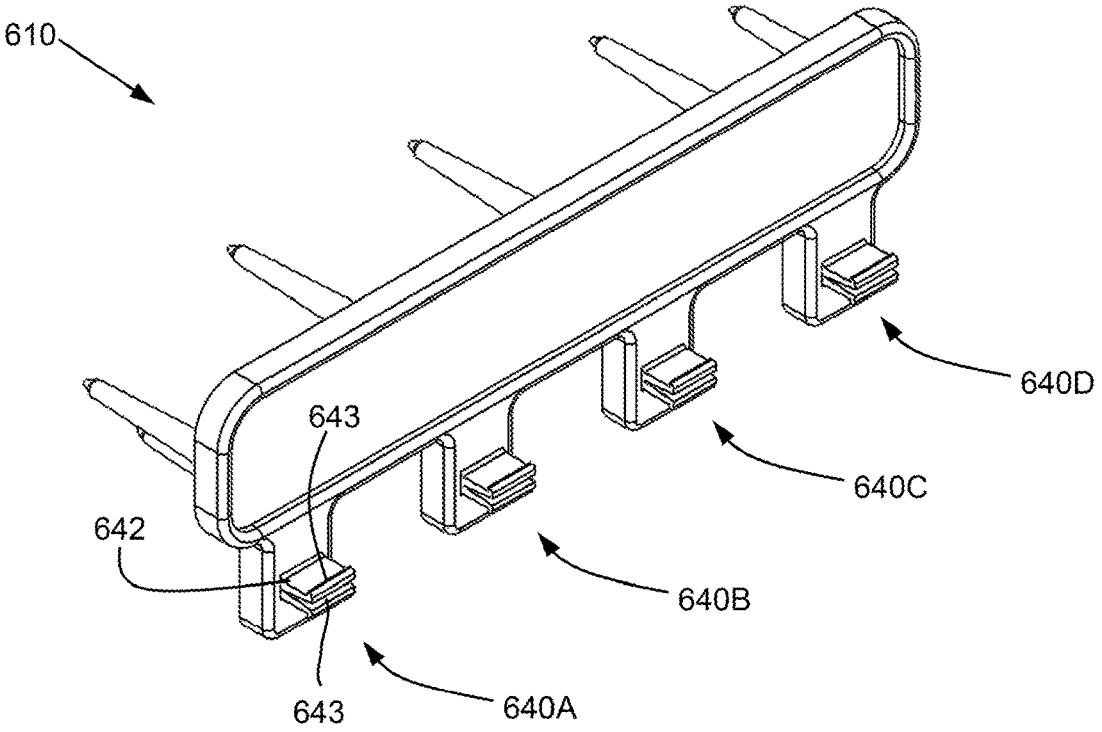
FIG. 6 is a schematic perspective front view of a siding attachment accessory according to another embodiment of the disclosure.

For example, in some embodiments, each siding hanger includes a retaining arm having a proximal end attached to the front face of the attachment platform and a distal end spaced from the attachment platform, where the retaining arm includes a pair of prongs that are configured to snap into an aperture in the siding component. Such a siding attachment accessory is shown in FIG. 6. Siding attachment accessory 610 includes a snap-on configuration where the retaining arm 642 of each siding hanger 640A-640D includes a pair of prongs 643, as illustrated with respect to siding hanger 640A. The pair of prongs 643 are configured to be inserted through an aperture in a siding component and to snap onto the siding component after passing through the aperture. For example, in some embodiments, the two prongs flare away from one another. As the retaining arm is inserted through an aperture in the siding component, the prongs may be deflected toward one another until the distal end of the retaining arm passes through the aperture and the pronged ends snap onto the siding component. For example, the prongs may each include a barb at the distal end that engages the front face of the siding component to hinder removal of the retaining arm from the aperture.

Figure 7:
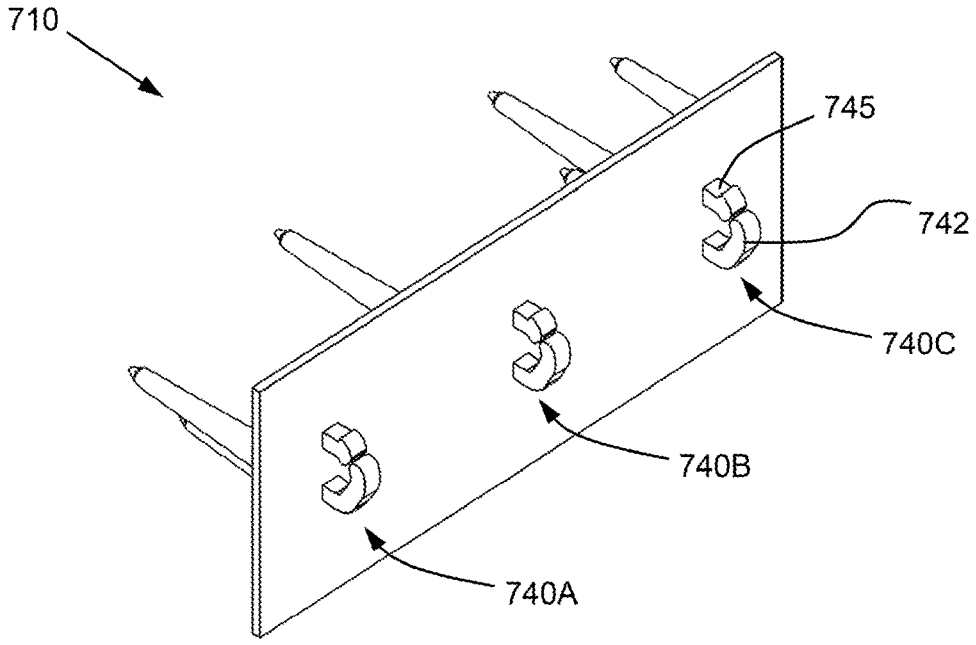
FIG. 7 is a schematic perspective front view of a siding attachment accessory according to another embodiment of the disclosure.

As another example of a siding hanger, siding attachment accessory 710, shown in FIG. 7, includes siding hangers 740A-740C that, as illustrated with respect to siding hanger 740C, each has a retaining arm with a hooked configuration that curves toward a latch 745 to create an enclosed space for retaining a fastening strip of a siding component.

In certain embodiments of the siding attachment accessory as otherwise described herein, the siding hanger includes an overhang that is configured as a hook and the distal end of the overhang curves toward the retaining arm. For example, distal end 156 of overhang 152 has a hooked configuration and curves toward retaining arm 142. Indeed, the distal ends 146, 156 of both the retaining arm 142 and the overhang 152 curve toward one another, such that the distal ends 146, 156 point at one another.

In certain embodiments of the siding attachment accessory as otherwise described herein, the overhang is wider than the retaining arm. For example, overhang 152 of siding hanger 140 of siding attachment accessory 110 is wider than retaining arm 142. The added width of overhang 152 prevents rotation of any siding component that is secured by siding hanger 140 by bracing the top edge of the fastening strip of the siding component. On the other hand, the smaller width of retaining arm 142 allows greater movement of retaining arm 142 along the slotted aperture of the attached fastening strip.

In certain embodiments of the siding attachment accessory as otherwise described herein, the distal end of the retaining arm and the distal end of the overhang are separated by a gap. For example, distal end 146 of retaining arm 142 points toward the distal end 156 of overhang 152 with a gap formed therebetween. The gap forms an opening into the space where a portion of a fastening strip of a siding component is held once retaining arm 142 passes through an aperture in the fastening strip. In other embodiments, this space is closed. For example, in siding attachment accessory 710, retaining arm 740 contacts latch 745 creating an enclosed space that secures a portion of the fastening strip. In order to secure the retaining arm 742 onto a fastening strip, the retaining arm 742 is bent outward away from latch 745.

In certain embodiments of the siding attachment accessory as otherwise described herein, a distance that the distal end of the retaining arm extends from the attachment platform is substantially the same as a distance that the distal end of the overhang extends from the attachment platform. For example, retaining arm 142 and overhang 152 of each siding hanger 140 of siding attachment accessory 110 both extend the same distance forward from attachment platform 120. In other embodiments, the overhang projects further than the retaining arm. On the other hand, in some embodiments, the retaining arm projects further than the overhang.

In certain embodiments of the siding attachment accessory as otherwise described herein, the at least one siding hanger includes three siding hangers disposed in a line. For example, siding attachment accessory 110 includes three siding hangers 140A-140C disposed in a line along the width of the siding attachment accessory 110. Siding attachment accessories 410 and 710 also includes three siding hangers disposed in a line. Similarly, siding attachment accessory 610 also includes three siding hangers 640A-640C disposed in a line along the width of siding attachment accessory 610. Further, siding attachment accessory 610 also includes a fourth siding hanger 640D that is also disposed along the same line as siding hangers 640A-640C. In other embodiments, the position of the siding hangers is staggered. For example, in some embodiments, the siding hangers are positioned at different heights across the width of the siding attachment accessory. Such an embodiment may be configured for use with a siding component that similarly has staggered apertures or slots along the length of the corresponding fastening strip.

In certain embodiments of the siding attachment accessory as otherwise described herein, the attachment platform includes a platform body and a plurality of projections extending laterally outward from the platform body, where the platform body and the plurality of projections have a substantially planar configuration, and where each siding hanger is disposed on a respective one of the projections. For example, attachment platform 120 of siding attachment accessory 110 includes a large planar body 130 that extends across a width 112 of the siding attachment accessory 110. Several projections 132A-132C that are part of attachment platform 120 extend laterally outward from an edge of body 130 in the same plane as body 130. Each of the siding hangers 140A-140C is disposed on a respective one of the projections 132A-132C. The projections 132A-132C allow the siding hangers 140A-140C to be positioned at a distance from the aperture 134 that extends through the body 130 of attachment platform 120. This distance between the aperture 134 and the siding hangers 140A-140C allows easy installation of a mechanical fastener through the aperture 130 without any interference with the siding hangers 140A-140C.

In certain embodiments of the siding attachment accessory as otherwise described herein, the attachment platform includes an aperture configured to receive a mechanical fastener for securing the siding attachment accessory to a support surface. For example, siding attachment accessory 110 includes an aperture 134 through the center of attachment platform 120. As shown in FIGS. 3C and 3D, the aperture 134 may be used to receive a mechanical fastener that secures siding attachment accessory 110 to a support structure.

In certain embodiments of the siding attachment accessory as otherwise described herein, the siding attachment accessory has a width of at least 2 inches, e.g., at least 2.5 inches, e.g., at least 3 inches. Further, in some embodiments, the siding attachment accessory has a width of no more than 24 inches, e.g., no more than 18 inches, e.g., no more than 12 inches. For example, in some embodiments, the siding attachment accessory has a width in a range from 2 inches to 12 inches, e.g., from 2.5 inches to 8 inches, e.g., from 3 inches to 6 inches.

In certain embodiments of the siding attachment accessory as otherwise described herein, the siding attachment accessory is injection molded. In other embodiments, the siding attachment accessory is formed by another method, for example extrusion, casting, machining, punching, or additive manufacturing, such as 3D-printing.

In certain embodiments of the siding attachment accessory as otherwise described herein, the siding attachment accessory is formed of one or more of polypropylene, polyethylene, polyvinyl chloride (PVC), acrylonitrile styrene acrylate (ASA), acrylonitrile ethylene styrene (AES), polyurethane, or acrylonitrile butadiene styrene (ABS). Other materials are also possible, such as other polymers, or metals, such as steel or aluminum.

In another aspect, the disclosure provides a building surface siding system including a support structure, a first siding attachment accessory according to the disclosure attached to the support structure, and a first siding panel secured to the support structure with the first siding attachment accessory. The siding panel includes a panel body, a first lock disposed along a first edge of the panel body, a second lock disposed along a second edge of the panel body, and a fastening strip coupled to the first lock. The fastening strip includes apertures therethrough and the retaining arm of each of the siding hangers of the first siding attachment accessory extends through an aperture of the fastening strip of the first siding panel so as to secure the first siding panel to the support structure. The term siding, as used herein, includes soffit.

Figure 8:
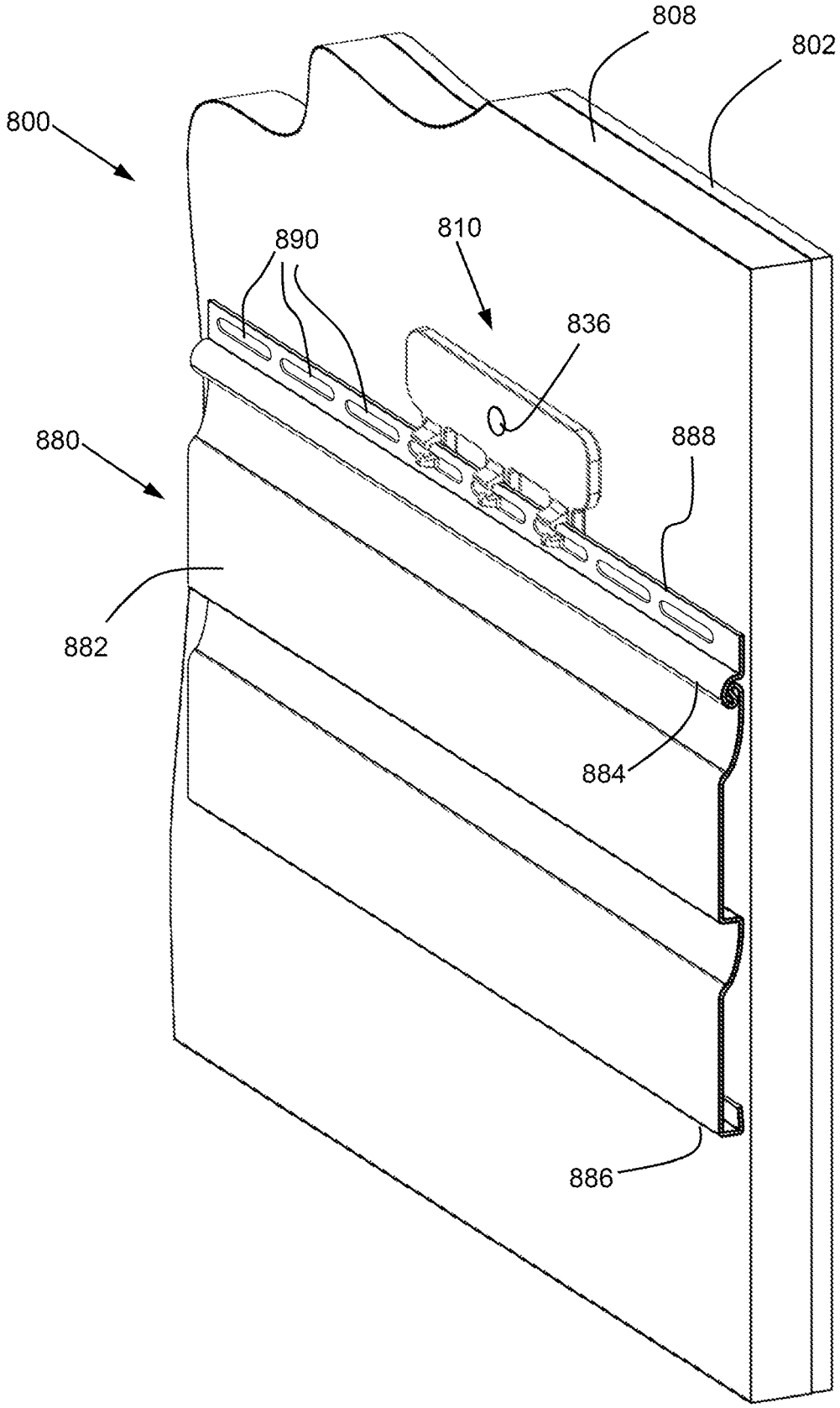
FIG. 8 is a schematic perspective side view of a siding system according to an embodiment of the disclosure.
Figure 9:
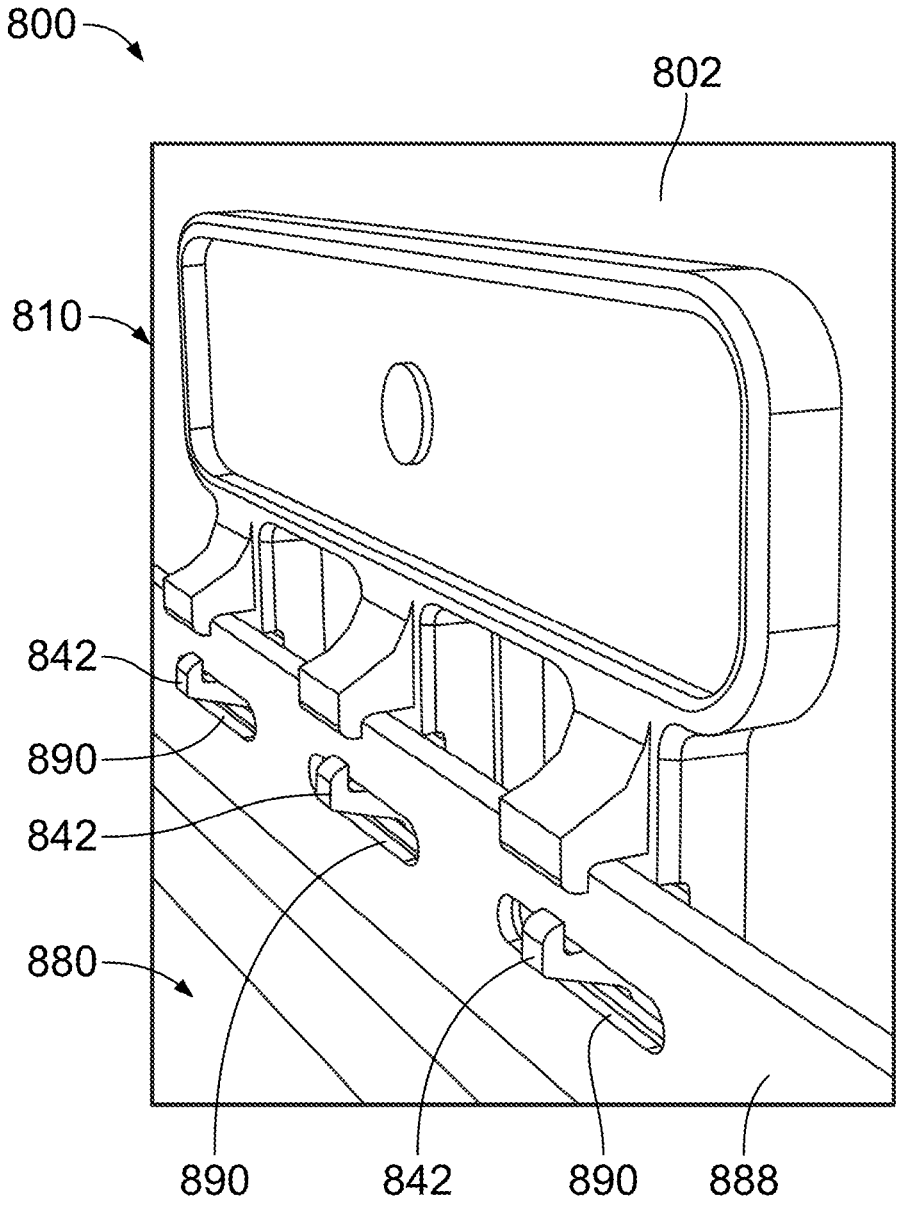
FIG. 9 is a detailed schematic perspective side view of the siding system of FIG. 8.

Such a building surface siding system is shown in FIG. 8. Building surface siding system 800 includes a support structure 802 in the form of exterior sheathing 806 with a first siding attachment accessory 810 secured to the support structure 802. A first siding panel 880 is secured to the support structure 802 using the first siding attachment accessory 810. The first siding panel 880 includes a panel body 882 with a first lock 884 disposed along a first upper edge of panel body 882 and a second lock 886 disposed along a second lower edge of panel body 882. The first siding panel 880 also includes a fastening strip 888 that is coupled to first lock 884 along the upper edge of panel body 882. Fastening strip 888 includes a plurality of apertures 890 that are used to secure first siding panel 880 to first siding attachment accessory 810. As shown in FIG. 9, a retaining arm 842 of each of the siding hangers 840A-840C extends through a respective aperture 890 in the fastening strip 888. Accordingly, the first siding panel 880 hangs on the first siding attachment accessory 810 and is secured to the support structure 802.

In certain embodiments of the building surface siding system as otherwise described herein, the apertures in the fastening strip of the first siding panel are slots and the retaining arm of each siding hanger is configured to slide within the respective slot. For example, apertures 890 of fastening strip 888 are formed as slots that extend along the length of first siding panel 880. Accordingly, because first siding panel loosely hangs on first siding attachment accessory 810 via the slotted apertures 890, the first siding panel 880 is able to move laterally over the support structure 802 by moving with respect to siding attachment accessory 810. This allows first siding panel 880 to expand or contract without added stress on the components of the building surface siding system 800.

In certain embodiments of the building surface siding system as otherwise described herein, the first siding attachment accessory is attached to the support surface using a mechanical fastener. For example, siding attachment accessory 810 is secured to support structure 802 using a mechanical fastener 836 that extends through insulation 808 and penetrates the exterior sheathing of support structure 802. The penetration of mechanical fastener 836 into the support structure 802 holds the siding attachment accessory 810 firmly in place.

In certain embodiments of the building surface siding system as otherwise described herein, the first siding attachment accessory is one of a plurality of siding attachment accessories that secure the first siding panel to the support structure. For example, in some embodiments, the first siding panel is long and securely supporting the first siding panel without sagging or bending uses several siding attachment accessories along the length of the first siding panel, where each siding attachment accessory secures a different section of the first siding panel to the support structure.

Figure 14:
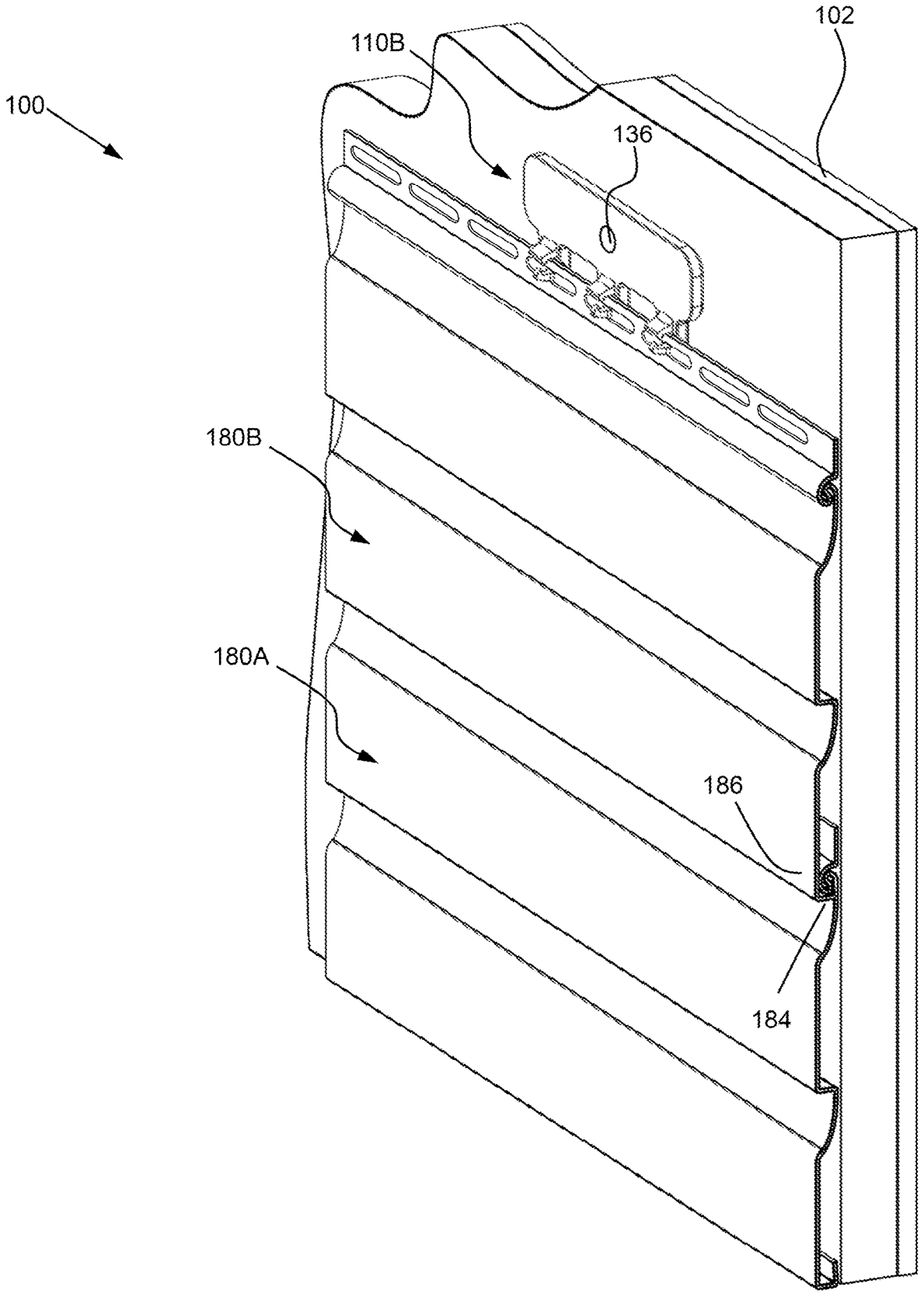
FIG. 14 is a schematic perspective view of another step in the method of FIG. 11.

In certain embodiments of the building surface siding system as otherwise described herein, the system further includes a second siding attachment accessory according to the disclosure attached to the support structure and a second siding panel. The second siding panel also includes a panel body, a first lock disposed along a first edge of the panel body, a second lock disposed along a second edge of the panel body, and a fastening strip coupled to the first lock, where the fastening strip including apertures therethrough. Like the first siding attachment accessory, the retaining arm of each of the siding hangers of the second siding attachment accessory extends through an aperture of the fastening strip of the second siding panel so as to secure the second siding panel to the support structure. Moreover, the two siding panels are attached to one another in that the first lock of the first siding panel is coupled to the second lock of the second siding panel. An embodiment of a building surface siding system including such a second siding attachment accessory and second siding panel is shown in FIG. 14, which is described in more detail below.

Figure 10:
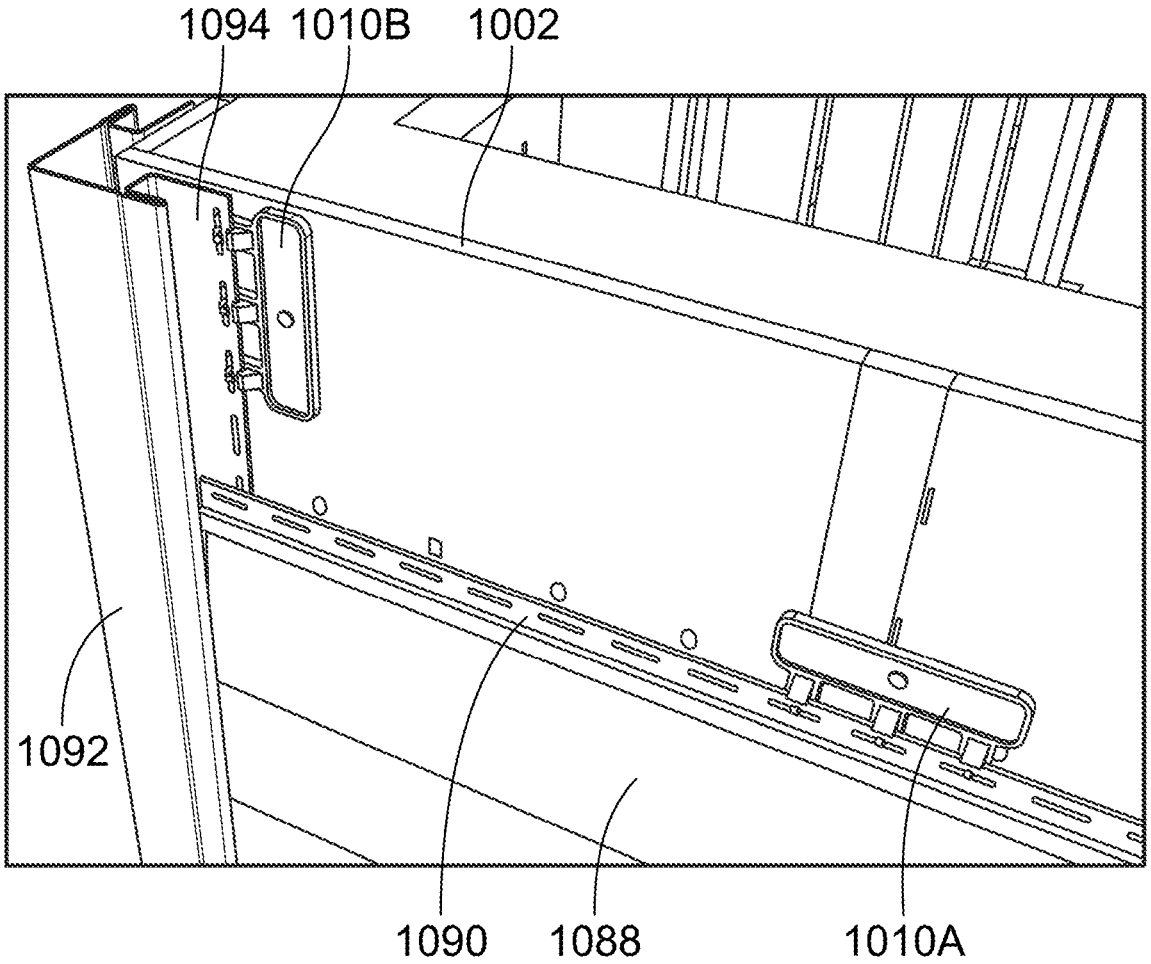
FIG. 10 is a schematic perspective side view of yet another siding system according to an embodiment of the disclosure.

In certain embodiments of the building surface siding system as otherwise described herein, the system further includes an additional siding attachment accessory according to the disclosure attached to the support structure and a siding accessory. The siding accessory is held to support structure by the additional siding attachment accessory. In particular, the retaining arm of each of the siding hangers of the additional siding attachment accessory extends through an aperture of the siding accessory so as to secure the siding accessory to the support structure. Such a building surface siding system is shown in FIG. 10. Building surface siding system 1000 includes a support structure 1002 with a siding panel 1088 and a siding accessory 1092 that are each secured to the support structure 1002 with a respective siding attachment accessory 1010A, 1010B. Siding panel 1088 includes a fastening strip 1090 that hangs on the siding hangers of first siding attachment accessory 1010A. Likewise, siding accessory 1092 includes a fastening strip 1094 that hangs on additional siding attachment accessory 1010B. Notably, siding accessory 1092 is oriented vertically and additional siding attachment accessory 1010B is also oriented vertically, as embodiments of the siding attachment accessory described herein are configured to operate at various different angles.

In certain embodiments of the building surface siding system as otherwise described herein, the siding accessory is selected from a group including starter strip, j-channel, lineal, and corner post. For example, siding accessory 1092 of building surface siding system 1000 is an exterior corner post. In some embodiments, the siding accessory is an interior corner posts. Further, various other embodiments include other additional types of siding accessories.

In certain embodiments of the building surface siding system as otherwise described herein, the first siding attachment accessory includes a plurality of support legs extending rearward from the rear surface of the attachment platform, where the plurality of support legs contact the support surface so as to hold the first siding attachment accessory at a distance from the support surface. Further, insulation is disposed between the attachment platform of the first siding attachment accessory and the support surface, and the support legs of the first siding attachment accessory extend through the insulation. For example, building surface siding system 800 includes a layer of insulation 808 disposed on the front of support structure 802. As explained in more detail above with respect to the embodiment shown in FIGS. 3A-3D, legs of the siding attachment accessory 810 penetrate through the layer of insulation 808 to engage support structure 802. Accordingly, first siding panel 880 is secured to support structure 802 but allows for the inclusion of insulation layer 808 therebetween.

In other embodiments, the siding attachment accessory does not include any support legs. For example, in some embodiments, the rear face of the attachment platform is positioned directly on the outer surface of the support structure. In some embodiments, such a siding attachment accessory is secured to the support structure using a mechanical fastener. In other embodiments such a siding attachment accessory is secured to the support structure by other means, such as adhesive on the rear face of the attachment platform.

In another aspect, the disclosure provides a method of constructing a building surface siding system according to the disclosure. The method includes securing the first siding panel to the support structure using the first siding attachment accessory such that the retaining arm of each of the siding hangers of the first siding attachment accessory extends through an aperture of the fastening strip of the first siding panel. In some embodiments, the first siding attachment accessory is one of a plurality of siding attachment accessories that secure the first siding panel to the support structure. For example, in some embodiments, several siding attachment accessories are positioned along the length of the fastening strip so as to hold the first siding panel to the support strip.

Embodiments of methods according to the disclosure are shown in FIGS. 11-14 and 15-19.

Figure 11:
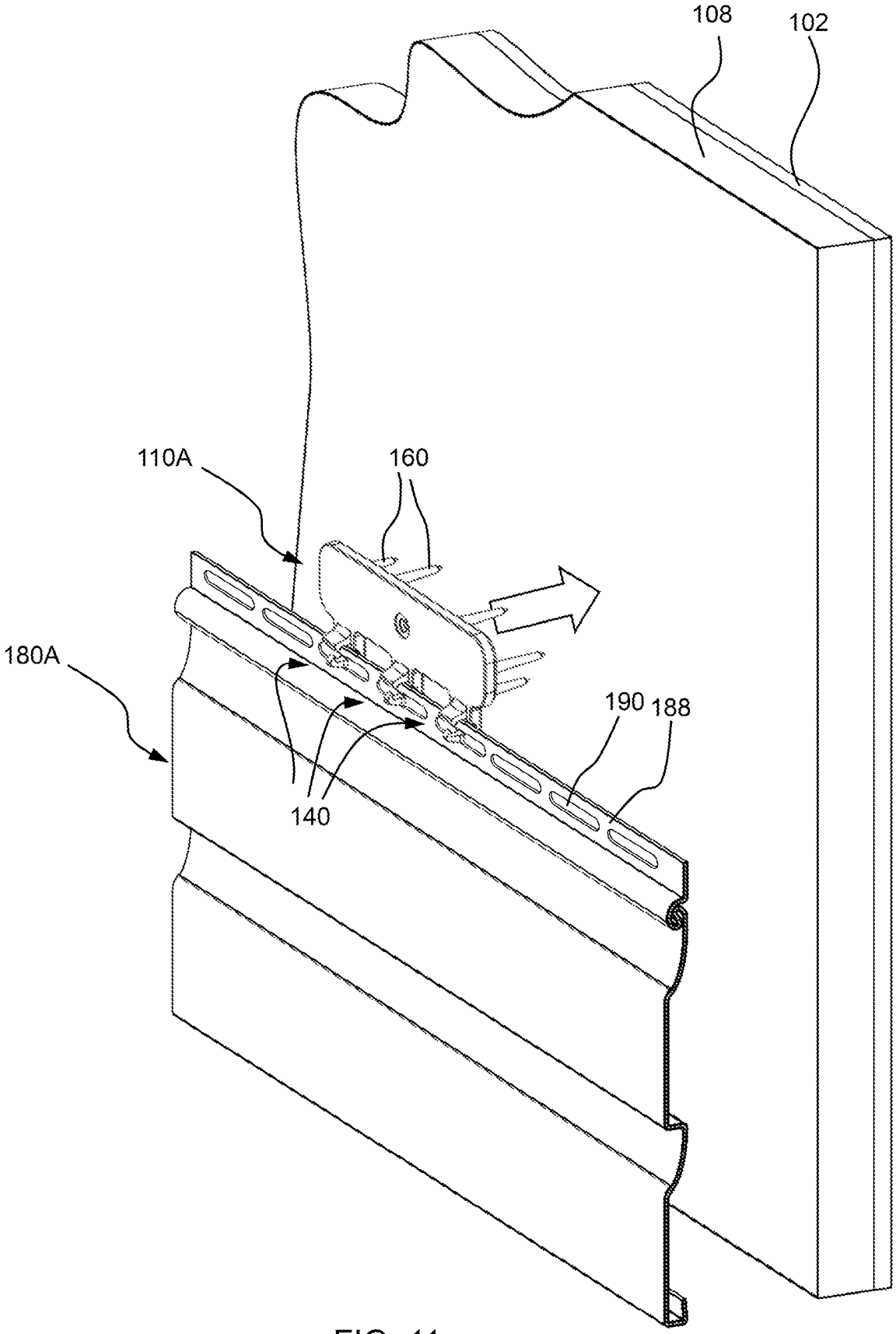
FIG. 11 is a schematic perspective view of a step in a method of installing a siding system according to an embodiment of the disclosure.

In certain embodiments of the method of constructing a building surface siding system as otherwise described herein, securing the first siding panel to the support structure includes inserting the retaining arm of each siding hanger of the first siding attachment accessory through an aperture in the fastening strip of the first siding panel. For example, FIG. 11 shows a first siding panel 180A and a first siding attachment accessory 110A positioned in front of a support structure 102. In some embodiments, the method includes attaching first siding attachment accessory 110A to first siding panel 180A by inserting a retaining arm of each siding hanger 140 of first siding attachment accessory 110A through a respective slot 190 in fastening strip 188 of first siding panel 180A. In other embodiments, the first siding attachment accessory is pre-installed on the first siding panel. For example, in some embodiments, the siding attachment accessories of the disclosure are secured to the fastening strip of the siding panel by a manufacturer, and the step of coupling the siding attachment accessory and siding panel is performed remotely from the installation method.

Figure 12:
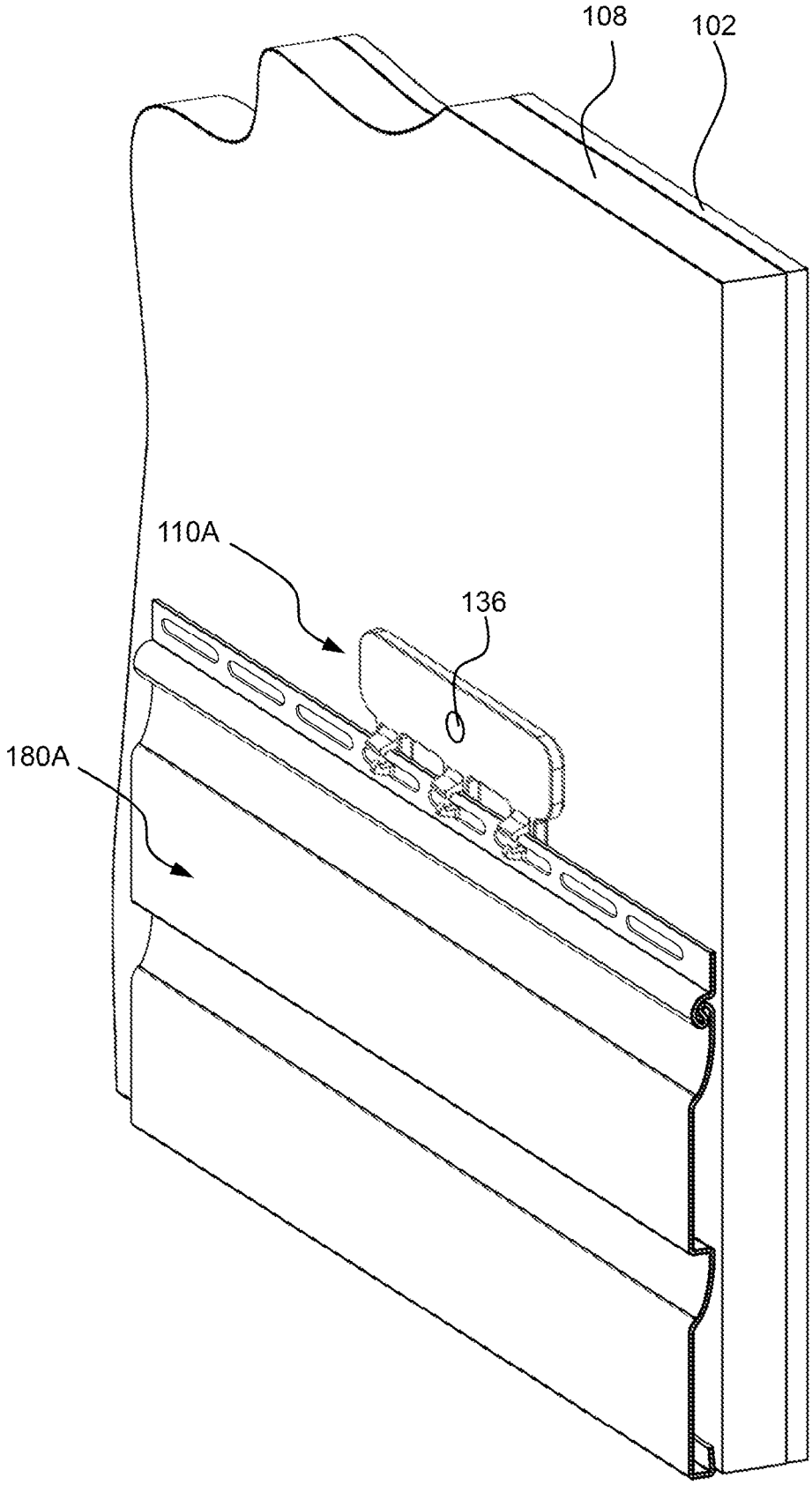
FIG. 12 is a schematic perspective view of another step in the method of FIG. 11.

In certain embodiments of the method of constructing a building surface siding system as otherwise described herein, securing the first siding panel to the support structure includes attaching the first siding attachment accessory to the support structure. For example, as shown in FIG. 12, first siding panel 180A and first siding attachment accessory 110A are secured to support structure 102.

In certain embodiments of the method of constructing a building surface siding system as otherwise described herein, attaching the first siding attachment accessory to the support structure includes fastening the first siding attachment accessory to the support structure using a mechanical fastener. For example, first siding attachment accessory 110A is held to the support structure 102 using a mechanical fastener 136, as shown in FIG. 12.

In certain embodiments of the method of constructing a building surface siding system as otherwise described herein, the mechanical fastener is driven into the support structure using a pneumatic tool. For example, in some embodiments, the mechanical fastener is driven into the support structure using a nail gun. Because the siding panel is loosely held onto the siding attachment accessory rather than directly to the support structure, there is no risk of pinning the siding panel to the support structure through the use of a nail gun or other fastening tool. Accordingly, the siding attachment accessories can be installed quickly and efficiently without jeopardizing the integrity of the siding system. In other embodiments, the mechanical fastener is driven into the support structure using another tool, or by hand.

In certain embodiments of the method of constructing a building surface siding system as otherwise described herein, attaching the first siding attachment accessory to the support structure includes inserting a plurality of support legs extending from the rear surface of the attachment platform of the first siding attachment accessory through a layer of insulation. For example, as shown in FIGS. 11-14, a layer of insulation 108 covers support structure 102. Accordingly, as shown in FIGS. 11 and 12, first siding attachment accessory 110A includes a plurality of support legs 160 that are inserted through the layer of insulation 108 as first siding attachment accessory 110A is secured to support structure 102.

Figure 13:
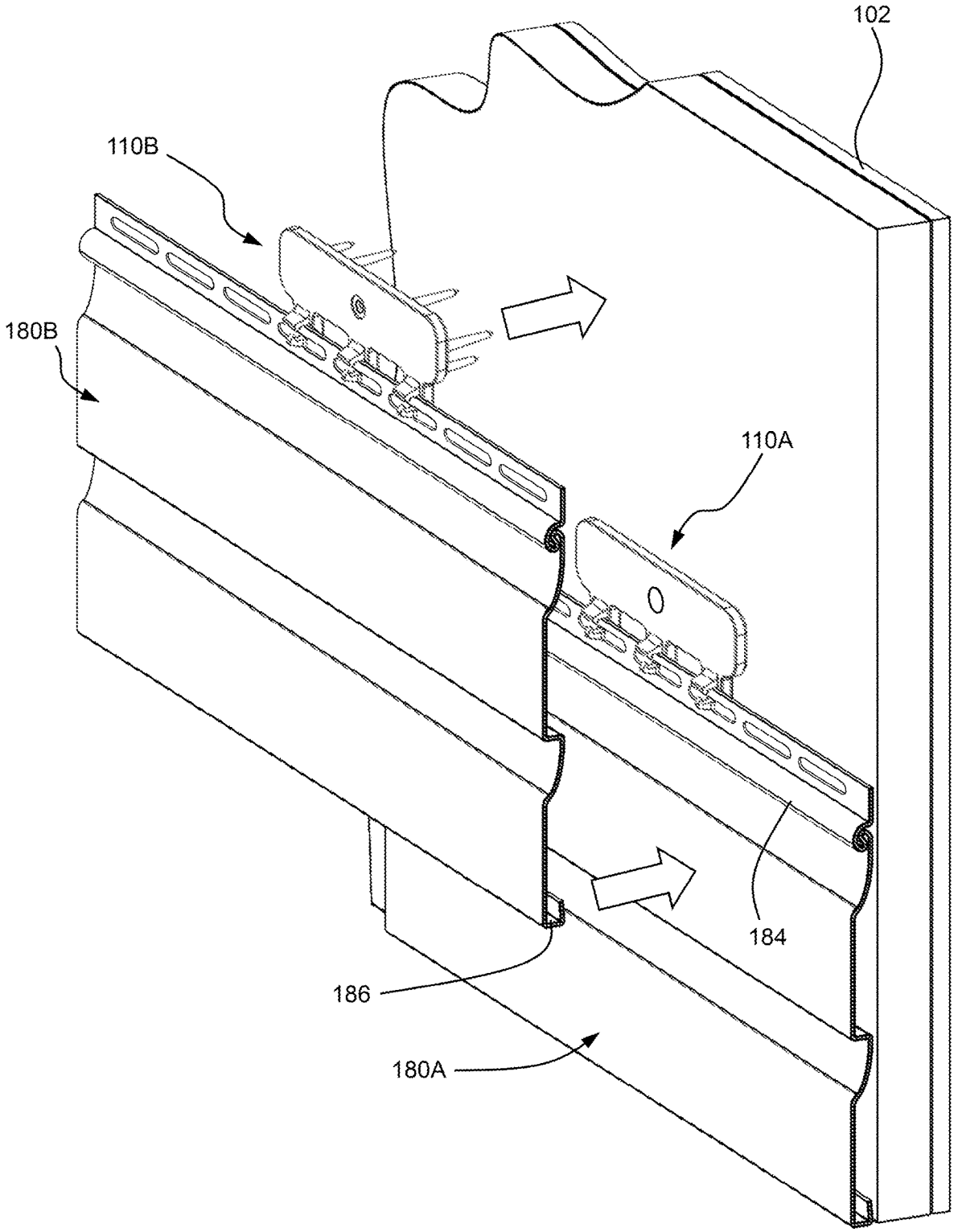
FIG. 13 is a schematic perspective view of another step in the method of FIG. 11.

In certain embodiments of the method of constructing a building surface siding system as otherwise described herein, the method further includes coupling a second lock of a second siding panel to the first lock of the first siding panel and securing the second siding panel to the support structure using a second siding attachment accessory. In particular, the second siding panel is held by the second siding attachment accessory such that the retaining arm of each of the siding hangers of the second siding attachment accessory extends through an aperture of the fastening strip of the second siding panel. For example, FIG. 13 shows a second siding panel 180B and a second siding attachment accessory 110B placed above first siding panel 180A in front of support structure 102. To install the second siding panel 180B, the second lock 186 of second siding panel 180B is coupled to the first lock 184 of first siding panel 180A. The second siding attachment accessory 110B is then pulled upward and toward support structure so as to find the proper location for second siding attachment accessory 110B. The second siding attachment accessory 110B is subsequently secured to the support structure using a mechanical fastener so as to form the building surface siding system 100 shown in FIG. 14.

Figure 15:
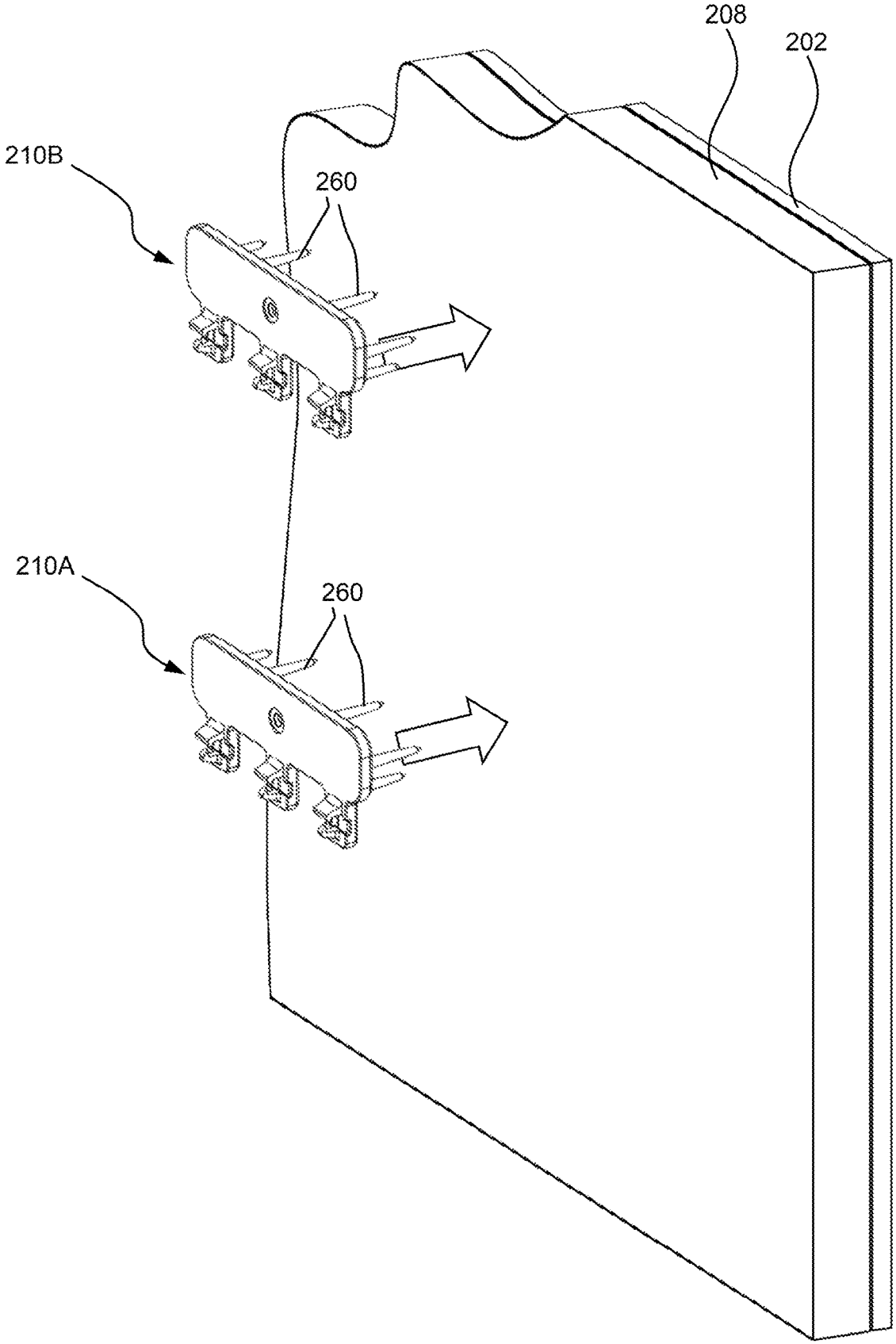
FIG. 15 is a schematic perspective view of a step in a method of installing a siding system according to an embodiment of the disclosure.
Figure 16:
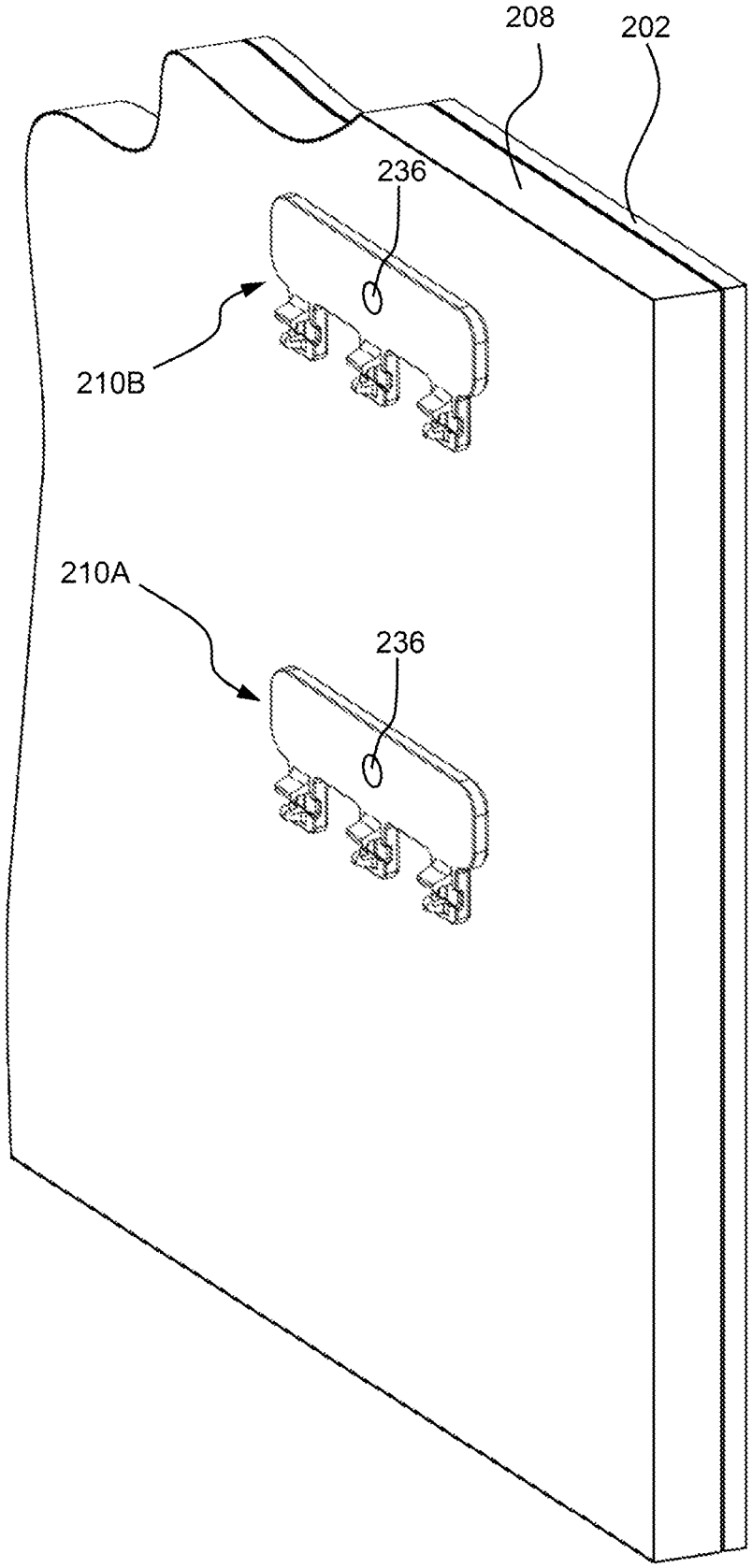
FIG. 16 is a schematic perspective view of another step in the method of FIG. 15.

In certain embodiments of the method of constructing a building surface siding system as otherwise described herein, the siding attachment accessories are secured to the support structure before being attached to the siding panels. Such a method is shown in FIGS. 15-19. As shown in FIG. 15, two siding attachment accessories 210A and 210B are positioned over a support structure 202. Further, the front surface of support structure 202 is covered by a layer of insulation 208. Each of the siding attachment accessories 210A and 210B include a plurality of support legs 260 that are pushed through the layer of insulation 208. The siding attachment accessories 210A and 210B are then secured to the support structure 202 by respective mechanical fasteners 236 that also penetrate the layer of insulation 208, as shown in FIG. 16.

In other embodiments, the siding attachment accessories are pre-installed on the support structure. For example, in some embodiments, the siding attachment accessories are installed on the support structure at a manufacturing site, for example, using a robot. Accordingly, such a support structure may be part of a prefabricated wall. During installation the prefabricated wall is secured in place, and then siding panels are attached to the siding attachment accessories. Such an embodiment can greatly reduce installation time on site.

Figure 17:
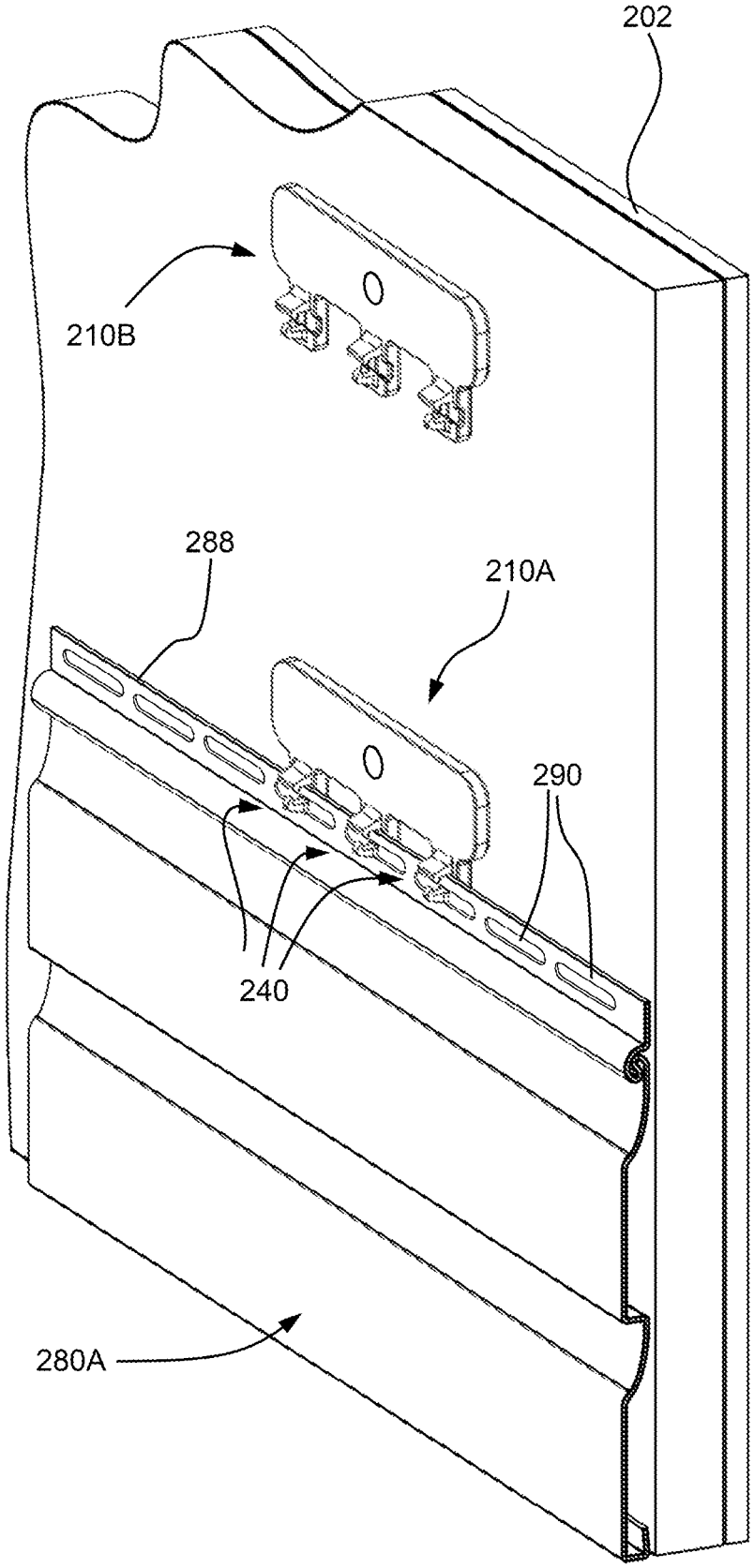
FIG. 17 is a schematic perspective view of another step in the method of FIG. 15.

Once the siding attachment accessories 210A and 210B are secured to the support structure, a first siding panel 280A is attached to the first siding attachment accessory 210A by inserting the retaining arm of each siding hanger 240 of the first siding attachment accessory 210A through the slotted apertures 290 in the fastening strip 288 of first siding panel 280A, as shown in FIG. 17. Thus, the first siding panel is securely held to the support structure via the first siding attachment accessory.

Figure 18:
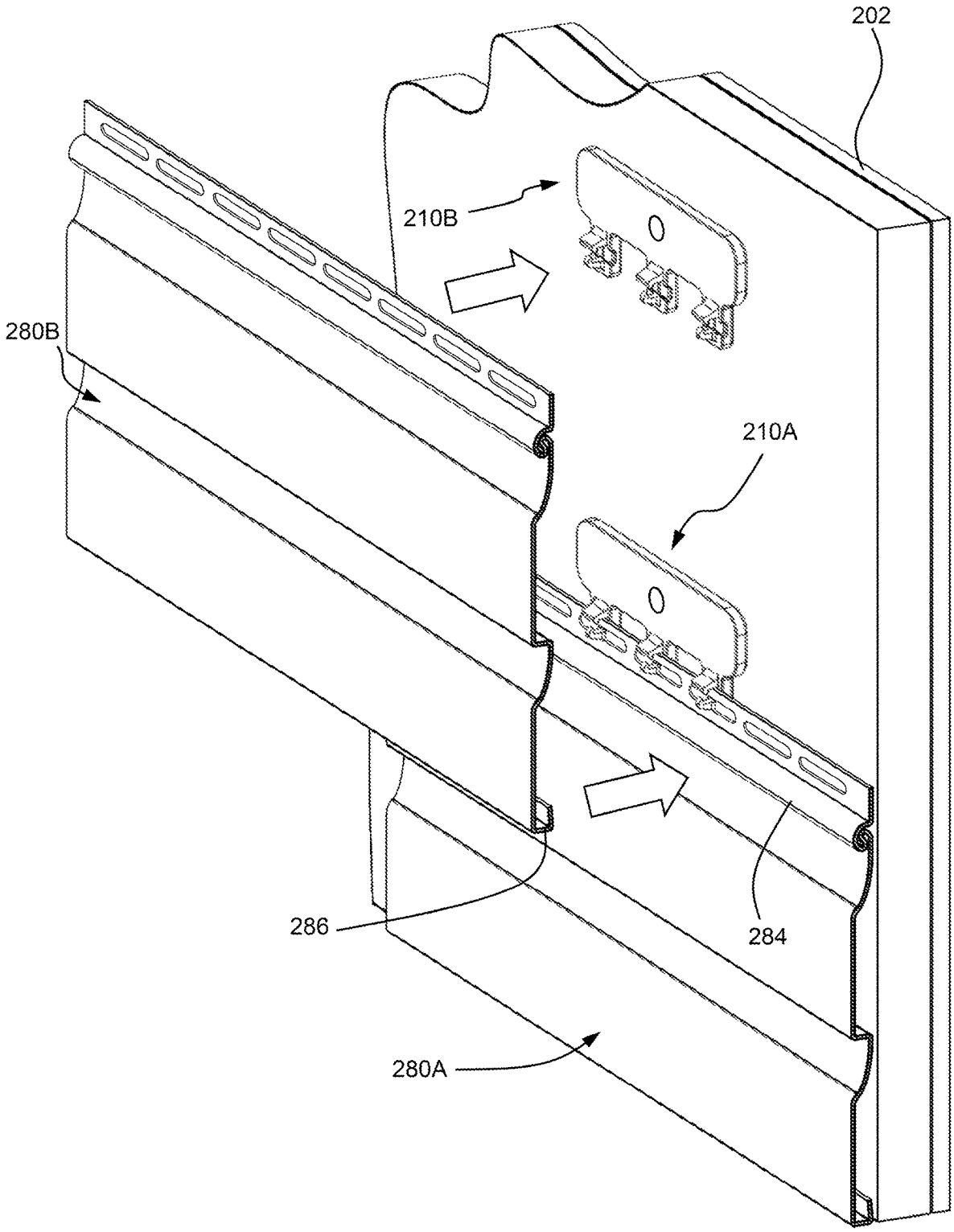
FIG. 18 is a schematic perspective view of another step in the method of FIG. 15.
Figure 19:
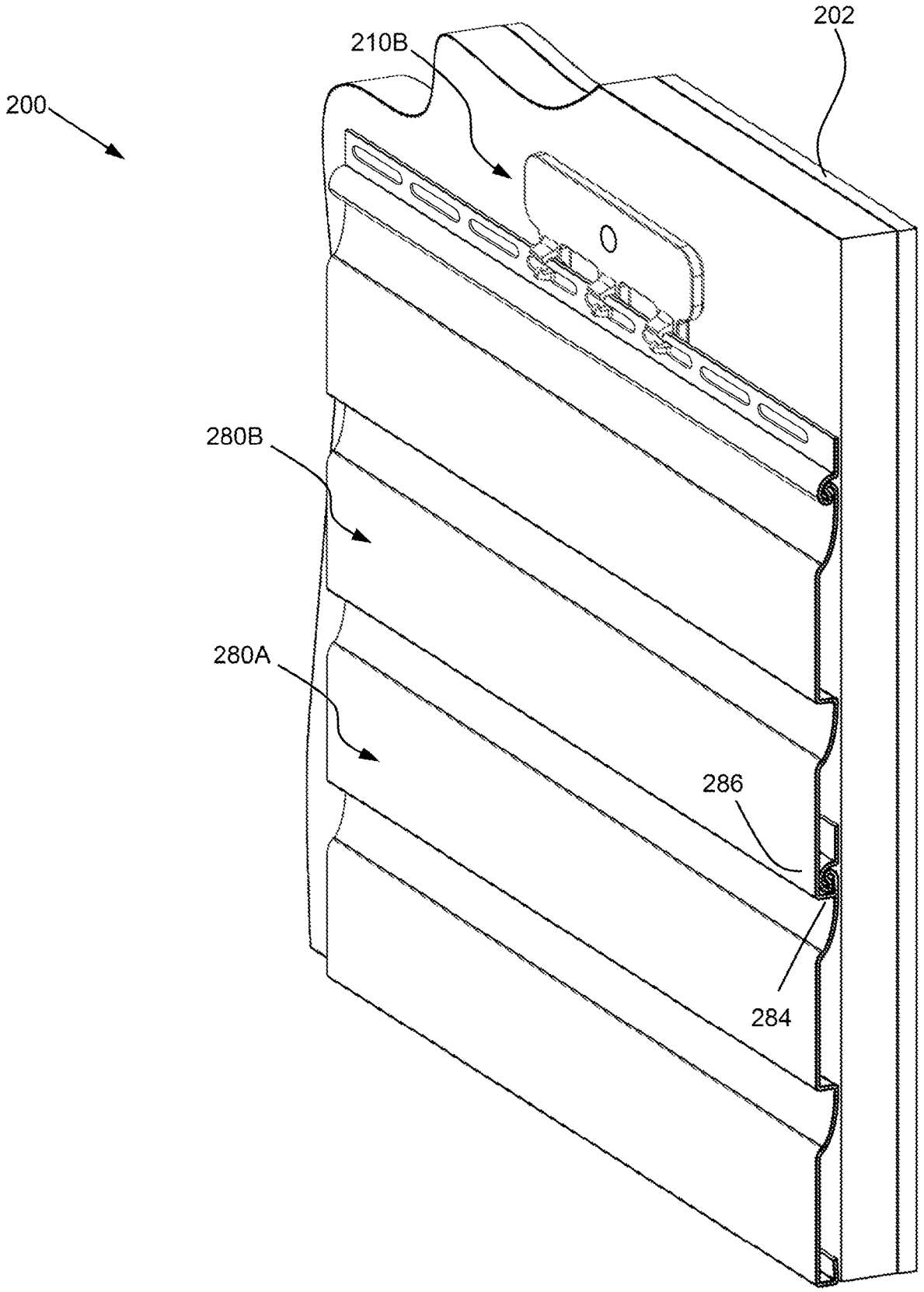
FIG. 19 is a schematic perspective view of another step in the method of FIG. 15.
Figure 20:
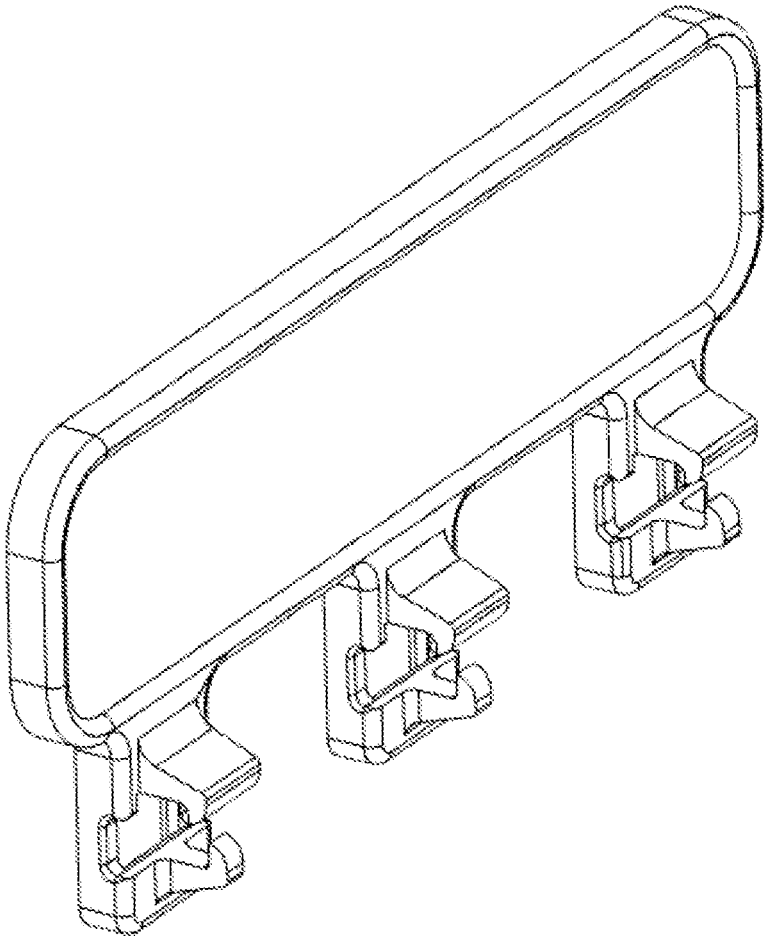
FIG. 20 is a perspective view of a siding attachment accessory according to an embodiment of the disclosure.
Figure 21:
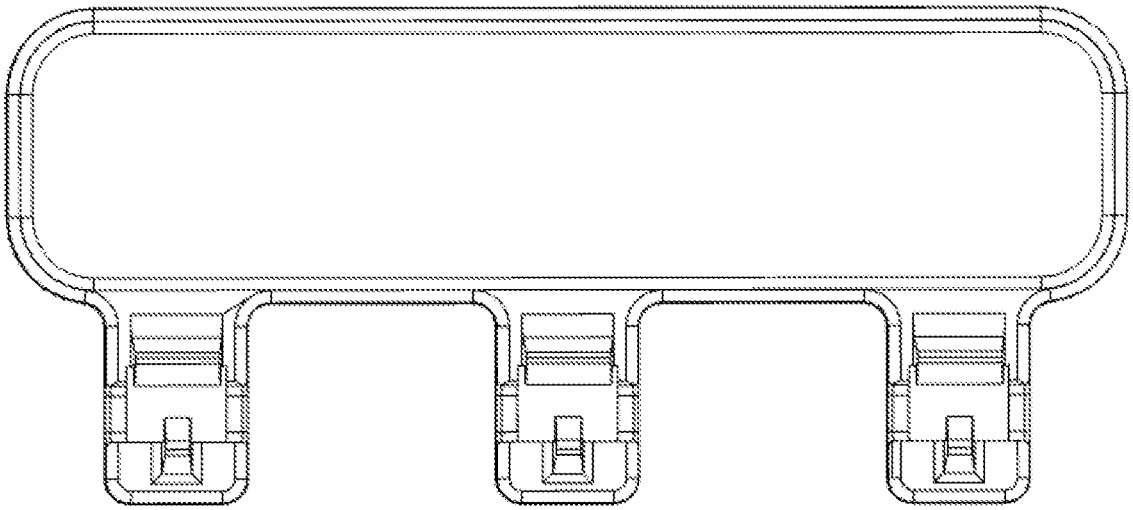
FIG. 21 is a front elevational view of the siding attachment accessory of FIG. 20.
Figure 22:
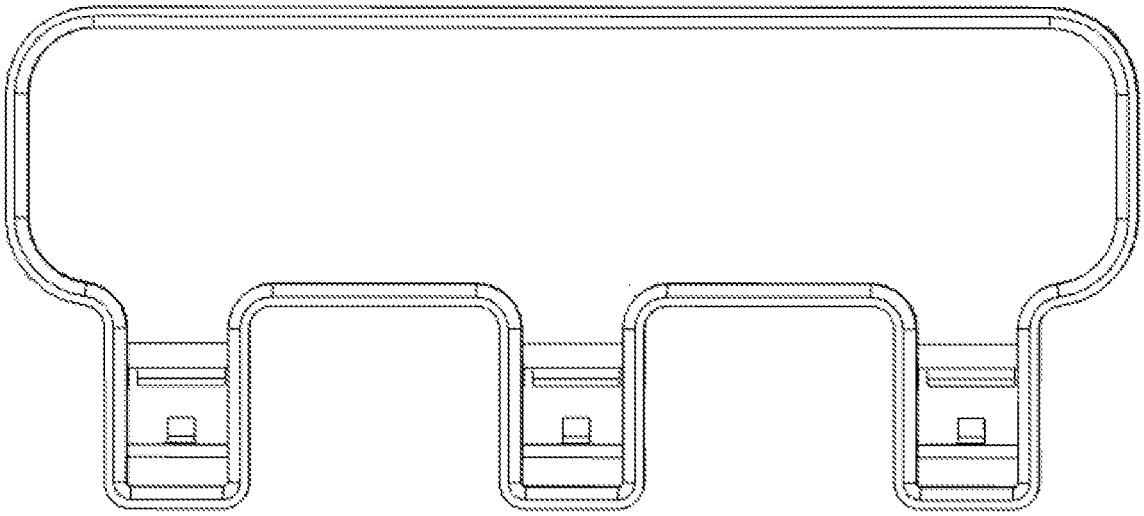
FIG. 22 is a rear elevational view of the siding attachment accessory of FIG. 20.
Figure 23:
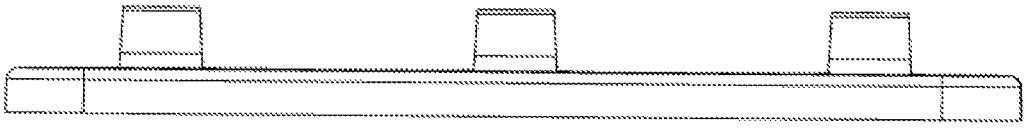
FIG. 23 is a top elevational view of the siding attachment accessory of FIG. 20.
Figure 24:
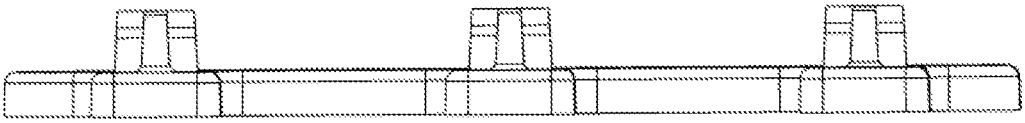
FIG. 24 is a bottom elevational view of the siding attachment accessory of FIG. 20.
Figure 25:
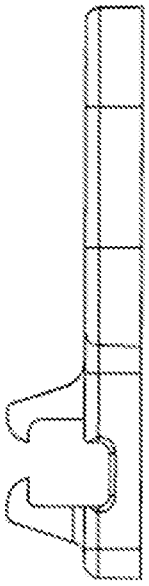
FIG. 25 is a right side elevational view of the siding attachment accessory of FIG. 20.
Figure 26:
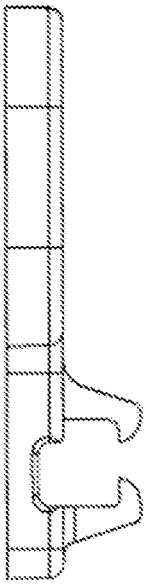
FIG. 26 is a left side elevational view of the siding attachment accessory of FIG. 20.
Figure 27:
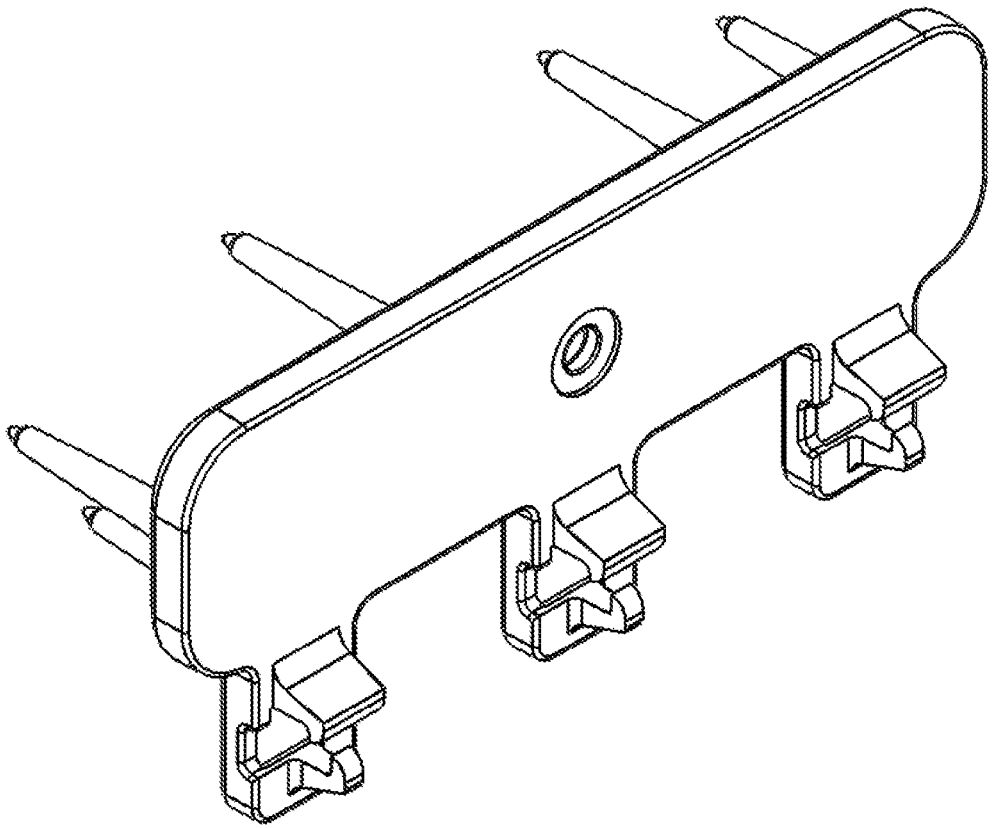
FIG. 27 is a perspective view of a siding attachment accessory according to an embodiment of the disclosure.
Figure 28:
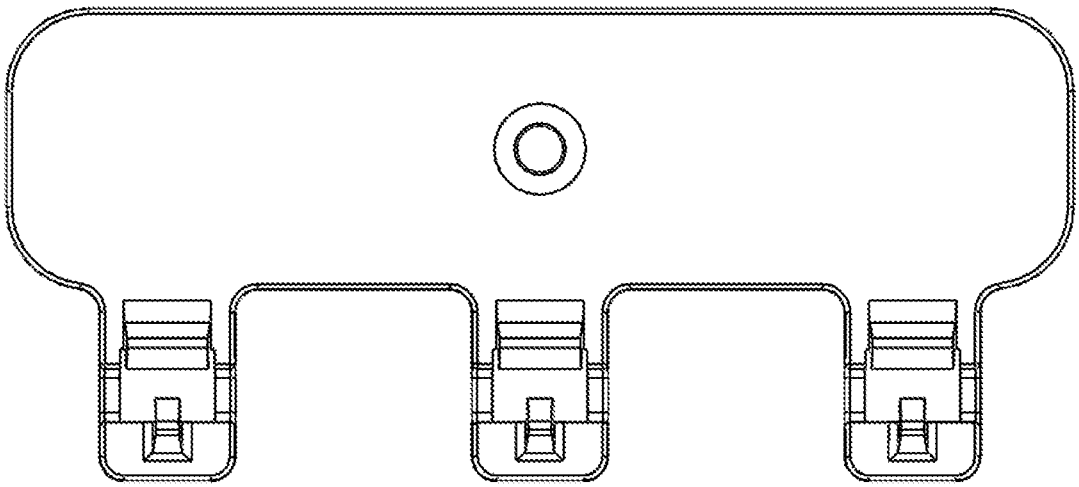
FIG. 28 is a front elevational view of the siding attachment accessory of FIG. 27.
Figure 29:
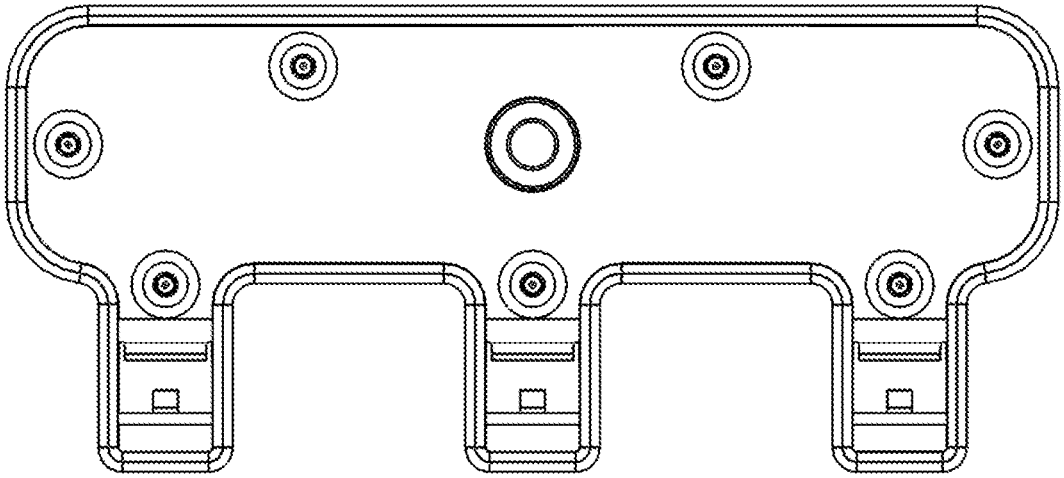
FIG. 29 is a rear elevational view of the siding attachment accessory of FIG. 27.
Figure 30:
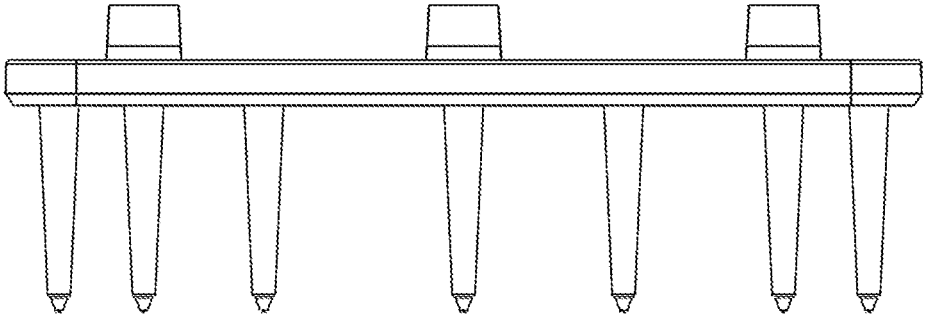
FIG. 30 is a top elevational view of the siding attachment accessory of FIG. 27.
Figure 31:
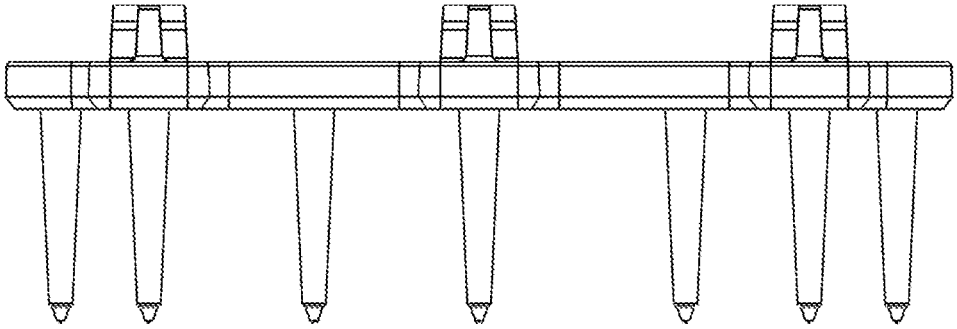
FIG. 31 is a bottom elevational view of the siding attachment accessory of FIG. 27.
Figure 32:
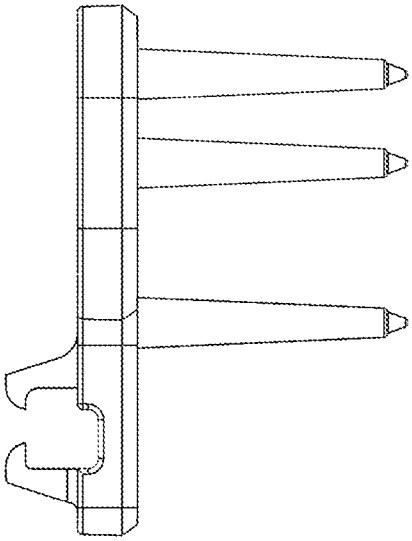
FIG. 32 is a right side elevational view of the siding attachment accessory of FIG. 27.
Figure 33:
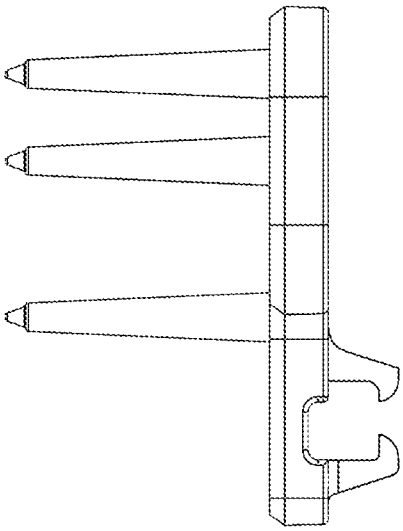
FIG. 33 is a left side elevational view of the siding attachment accessory of FIG. 27.

As shown in FIGS. 18 and 19, a second siding panel 280B is then positioned in front of support structure 202. The second siding panel 280B is secured to support structure 202 by coupling the second lock 286 of second siding panel 280B to the first lock 284 of first siding panel 280A and by attaching the fastening strip 288 of second siding panel

280B to second siding attachment accessory 210B, thereby forming building surface siding system 200.

Various aspects of the disclosure are provided by the following enumerated embodiments, which may be combined in any number and in any combination not technically or logically inconsistent:

Embodiment 1. A siding attachment accessory comprising:

an attachment platform including a front face and a rear face;

at least one siding hanger extending forward from the front face of the attachment platform and configured to hold a siding component, each siding hanger including a retaining arm having a proximal end attached to the front face of the attachment platform and a distal end spaced from the attachment platform; and a plurality of support legs extending rearward from the rear face of the attachment platform.

Embodiment 2. The siding attachment accessory according to embodiment 1, wherein at least three of the support legs are disposed in a non-linear arrangement so as to support the attachment platform Embodiment 3. The siding attachment accessory according to embodiment 1 or embodiment 2, wherein a respective one of the plurality of support legs is disposed behind each siding hanger.

Embodiment 4. The siding attachment accessory according to any of embodiments 1 to 3, wherein each support leg extends a distance of at least 0.5 inches from the rear face of the attachment platform, e.g., at least 0.75 inches, e.g., at least 1 inch.

Embodiment 5. The siding attachment accessory according to any of embodiments 1 to 4, wherein each support leg extends a distance of no more than 5.5 inches from the rear face of the attachment platform, e.g., no more than 5 inches, e.g., no more than 4 inches.

Embodiment 6. The siding attachment accessory according to any of embodiments 1 to 5, wherein each support leg extends a distance of from 0.5 inches to 3 inches from the rear face of the attachment platform, e.g., from 0.5 inches to 2.5 inches, or from 1 inch to 3 inches, or from 1 inch to 2.5 inches.

Embodiment 7. The siding attachment accessory according to any of embodiments 1 to 6, wherein each leg tapers inward from the attachment platform to a pointed tip.

Embodiment 8. The siding attachment accessory according to embodiment 7, wherein the pointed tip is configured to penetrate a support surface.

Embodiment 9. The siding attachment accessory according to embodiment 7, wherein the pointed tip is configured to deform upon contacting a support surface.

Embodiment 10. The siding attachment accessory according to any of embodiments 1 to 9, wherein each siding hanger further includes an overhang disposed over the retaining arm, the overhang having a proximal end attached to the front face of the attachment platform and a distal end spaced from the attachment platform, and wherein the retaining arm is configured as a hook and the distal end curves toward the overhang.

Embodiment 11. The siding attachment accessory according to embodiment 10, wherein the overhang is configured as a hook and the distal end of the overhang curves toward the retaining arm.

Embodiment 12. The siding attachment accessory according to embodiment 10 or embodiment 11, wherein the overhang is wider than the retaining arm.

Embodiment 13. The siding attachment accessory according to any of embodiments 10 to 12, wherein the distal end of the retaining arm and the distal end of the overhang are separated by a gap.

Embodiment 14. The siding attachment accessory according to any of embodiments 10 to 13, wherein a distance that the distal end of the retaining arm extends from the attachment platform is substantially the same as a distance that the distal end of the overhang extends from the attachment platform.

Embodiment 15. A siding attachment accessory comprising:

an attachment platform including a front face and a rear face; and at least one siding hanger extending forward from the front face of the attachment platform and configured to hold a siding component, each siding hanger including:

a retaining arm having a proximal end attached to the front face of the attachment platform and a distal end spaced from the attachment platform, and an overhang disposed over the retaining arm, the overhang having a proximal end attached to the front face of the attachment platform and a distal end spaced from the attachment platform, wherein the retaining arm is configured as a hook and the distal end curves toward the overhang.

Embodiment 16. The siding attachment accessory according to embodiment 15, wherein the overhang is configured as a hook and the distal end of the overhang curves toward the retaining arm.

Embodiment 17. The siding attachment accessory according to embodiment 15 or embodiment 16, wherein the overhang is wider than the retaining arm.

Embodiment 18. The siding attachment accessory according to any of embodiments 15 to 17, wherein the distal end of the retaining arm and the distal end of the overhang are separated by a gap.

Embodiment 19. The siding attachment accessory according to any of embodiments 15 to 18, wherein a distance that the distal end of the retaining arm extends from the attachment platform is substantially the same as a distance that the distal end of the overhang extends from the attachment platform.

Embodiment 20. A siding attachment accessory comprising:

an attachment platform including a front face and a rear face; and at least one siding hanger extending forward from the front face of the attachment platform and configured to hold a siding component, each siding hanger including:

a retaining arm having a proximal end attached to the front face of the attachment platform and a distal end spaced from the attachment platform, wherein the retaining arm includes a pair of prongs that are configured to snap into an aperture in the siding component.

Embodiment 21. The siding attachment accessory according to any of embodiments 1 to 20, wherein the at least one siding hanger includes three siding hangers disposed in a line.

Embodiment 22. The siding attachment accessory according to any of embodiments 1 to 21, wherein the attachment platform includes a platform body and a plurality of projections extending laterally outward from the platform body, wherein the platform body and the plurality of projections have a substantially planar configuration, and wherein each siding hanger is disposed on a respective one of the projections.

Embodiment 23. The siding attachment accessory according to any of embodiments 1 to 22, wherein the attachment platform includes an aperture configured to receive a mechanical fastener for securing the siding attachment accessory to a support surface.

Embodiment 24. The siding attachment accessory according to any of embodiments 1 to 23, wherein the siding attachment accessory has a width of at least 2 inches, e.g., at least 2.5 inches, e.g., at least 3 inches.

Embodiment 25. The siding attachment accessory according to any of embodiments 1 to 24, wherein the siding attachment accessory has a width of no more than 24 inches, e.g., no more than 18 inches, e.g., no more than 12 inches.

Embodiment 26. The siding attachment accessory according to any of embodiments 1 to 25, wherein the siding attachment accessory is injection molded.

Embodiment 27. The siding attachment accessory according to any of embodiments 1 to 26, wherein the siding attachment accessory is formed of one or more of polypropylene, polyethylene, polyvinyl chloride (PVC), acrylonitrile styrene acrylate (ASA), acrylonitrile ethylene styrene (AES), polyurethane, or acrylonitrile butadiene styrene (ABS).

Embodiment 28. A building surface siding system comprising:

a support structure;

a first siding attachment accessory according to any of embodiments 1 to 27 attached to the support structure; and a first siding panel including a panel body, a first lock disposed along a first edge of the panel body, a second lock disposed along a second edge of the panel body, and a fastening strip coupled to the first lock, the fastening strip including apertures therethrough, wherein the retaining arm of each of the siding hangers of the first siding attachment accessory extends through an aperture of the fastening strip of the first siding panel so as to secure the first siding panel to the support structure.

Embodiment 29. The building surface siding system according to embodiment 28, wherein the apertures in the fastening strip of the first siding panel are slots and the retaining arm of each siding hanger is configured to slide within the respective slot.

Embodiment 30. The building surface siding system according to embodiment 28 or embodiment 29, wherein the first siding attachment accessory is attached to the support surface using a mechanical fastener.

Embodiment 31. The building surface siding system according to any of embodiments 28 to 30, wherein the first siding attachment accessory is one of a plurality of siding attachment accessories that secure the first siding panel to the support structure.

Embodiment 32. The building surface siding system according to any of embodiments 28 to 31, further comprising:

a second siding attachment accessory according to any of embodiments 1 to 27 attached to the support structure; and a second siding panel including a panel body, a first lock disposed along a first edge of the panel body, a second lock disposed along a second edge of the panel body, and a fastening strip coupled to the first lock, the fastening strip including apertures therethrough, wherein the retaining arm of each of the siding hangers of the second siding attachment accessory extends through an aperture of the fastening strip of the second siding panel so as to secure the second siding panel to the support structure, and wherein the first lock of the first siding panel is coupled to the second lock of the second siding panel.

Embodiment 33. The building surface siding system according to any of embodiments 28 to 32, further comprising:

an additional siding attachment accessory according to any of embodiments 1 to 27 attached to the support structure; and a siding accessory, wherein the retaining arm of each of the siding hangers of the additional siding attachment accessory extends through an aperture of the siding accessory so as to secure the siding accessory to the support structure.

Embodiment 34. The building surface siding system according to embodiment 33, wherein the siding accessory is selected from a group including starter strip, j-channel, lineal, and corner post.

Embodiment 35. The building surface siding system according to any of embodiments 28 to 34, wherein the first siding attachment accessory includes a plurality of support legs extending rearward from the rear surface of the attachment platform, the plurality of support legs contacting the support surface so as to hold the first siding attachment accessory at a distance from the support surface, wherein insulation is disposed between the attachment platform of the first siding attachment accessory and the support surface, and wherein the support legs of the first siding attachment accessory extend through the insulation.

Embodiment 36. A method of constructing a building surface siding system according to any of embodiments 28 to 35, the method comprising:

securing the first siding panel to the support structure using the first siding attachment accessory such that the retaining arm of each of the siding hangers of the first siding attachment accessory extends through an aperture of the fastening strip of the first siding panel.

Embodiment 37. The method of constructing a building surface siding system according to embodiment 36 wherein securing the first siding panel to the support structure includes inserting the retaining arm of each siding hanger of the first siding attachment accessory through an aperture in the fastening strip of the first siding panel.

Embodiment 38. The method of constructing a building surface siding system according to embodiment 36 or embodiment 37, wherein securing the first siding panel to the support structure includes attaching the first siding attachment accessory to the support structure.

Embodiment 39. The method of constructing a building surface siding system according to embodiment 38, wherein attaching the first siding attachment accessory to the support structure includes fastening the first siding attachment accessory to the support structure using a mechanical fastener.

Embodiment 40. The method of constructing a building surface siding system according to embodiment 39, wherein the mechanical fastener is driven into the support structure using a pneumatic tool.

Embodiment 41. The method of constructing a building surface siding system according to embodiment 39 or embodiment 40, wherein attaching the first siding attachment accessory to the support structure includes inserting a plurality of support legs extending from the rear surface of the attachment platform of the first siding attachment accessory through a layer of insulation.

Embodiment 42. The method of constructing a building surface siding system according to embodiment 36 or embodiment 37, wherein the first siding attachment accessory is pre-installed on the support structure.

Embodiment 43. The method of constructing a building surface siding system according to any of embodiments 36 to 42, further comprising:

coupling a second lock of a second siding panel to the first lock of the first siding panel; and securing the second siding panel to the support structure using a second siding attachment accessory such that the retaining arm of each of the siding hangers of the second siding attachment accessory extends through an aperture of the fastening strip of the second siding panel.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A siding attachment accessory comprising:

an attachment platform including a front face and a rear face; and a plurality of siding hangers extending forward from the front face of the attachment platform and configured to hold a siding component, each siding hanger of the siding hangers including:

a retaining arm having a proximal end attached to the front face of the attachment platform and a distal end spaced from the attachment platform, wherein the retaining arm includes a pair of prongs that are configured to snap into an aperture in the siding component, wherein the attachment platform includes a platform body and a plurality of projections extending laterally outward from the platform body, wherein the platform body and the plurality of projections have a substantially planar configuration, and wherein each siding hanger of the plurality of siding hangers is disposed on a respective one of the projections.

2. The siding attachment accessory according to claim 1, wherein the plurality of siding hangers includes three siding hangers disposed in a line.

3. The siding attachment accessory according to claim 1, wherein the attachment platform includes an aperture configured to receive a mechanical fastener for securing the siding attachment accessory to a support surface.

4. A building surface siding system comprising:

a support structure;

one or more siding attachment accessories according to claim 1, the one or more siding attachment accessories including a first siding attachment accessory attached to the support structure; and a first siding panel including a panel body, a first lock disposed along a first edge of the panel body, a second lock disposed along a second edge of the panel body, and a fastening strip coupled to the first lock, the fastening strip including at least one aperture therethrough, wherein the prongs of each siding hanger of the plurality of siding hangers of the first siding attachment accessory extends through an aperture of the fastening strip of the first siding panel so as to secure the first siding panel to the support structure.

5. The building surface siding system according to claim 4, wherein the one or more siding attachment accessories further comprises a second siding attachment accessory attached to the support structure, the system further comprising:

a second siding panel including a panel body, a first lock disposed along a first edge of the panel body, a second lock disposed along a second edge of the panel body, and a fastening strip coupled to the first lock, the fastening strip including an aperture therethrough, wherein the prongs of each siding hanger of the plurality of siding hangers of the second siding attachment accessory extends through the aperture of the fastening strip of the second siding panel so as to secure the second siding panel to the support structure, and wherein the first lock of the first siding panel is coupled to the second lock of the second siding panel.

6. A method of constructing a building surface siding system according to claim 4, the method comprising:

securing the first siding panel to the support structure using the first siding attachment accessory such that the prongs of each of the siding hangers of the first siding attachment accessory extends through an aperture of the fastening strip of the first siding panel.

7. A siding attachment accessory comprising:

an attachment platform including a front face and a rear face;

one or more siding hangers extending forward from the front face of the attachment platform and configured to hold a siding component, each siding hanger of the one or more siding hangers including:

a retaining arm having a proximal end attached to the front face of the attachment platform and a distal end spaced from the attachment platform, wherein the retaining arm includes a pair of prongs that are configured to snap into an aperture in the siding component; and a plurality of support legs extending rearward from the rear face of the attachment platform.

8. The siding attachment accessory according to claim 7, wherein the plurality of support legs includes at least three of the support legs are disposed in a non-linear arrangement so as to support the attachment platform.

9. The siding attachment accessory according to claim 7, wherein a respective one of the plurality of support legs is disposed behind each siding hanger.

10. The siding attachment accessory according to claim 7, wherein each support leg extends a distance of from 0.5 inches to 3 inches from the rear face of the attachment platform.

11. The siding attachment accessory according to claim 7, wherein each leg tapers inward from the attachment platform to a pointed tip.

12. The siding attachment accessory according to claim 11, wherein the pointed tip is configured to penetrate a support surface.

13. The siding attachment accessory according to claim 11, wherein the pointed tip is configured to deform upon contacting a support surface.

14. The building surface siding system according to claim 4, wherein each of the at least one aperture of the fastening strip of the first siding panel is a slot, and wherein the prongs of each of the siding hangers of the first siding attachment accessory are configured to slide within the respective slot.

15. The building surface siding system according to claim 14, wherein the first siding attachment accessory is attached to the support surface using a mechanical fastener.

16. The building surface siding system according to claim 14, wherein the first siding attachment accessory is one of a plurality of siding attachment accessories that secure the first siding panel to the support structure.

17. A building surface siding system comprising:

a support structure;

a first siding attachment accessory attached to the support structure, the first siding attachment accessory comprising an attachment platform including a front face and a rear face;

one or more siding hangers extending forward from the front face of the attachment platform and configured to hold a siding component, each siding hanger of the at least one siding hanger including a retaining arm having a proximal end attached to the front face of the attachment platform and a distal end spaced from the attachment platform, wherein the retaining arm includes a pair of prongs that are configured to snap into an aperture in the siding component; and a plurality of support legs extending rearward from the rear surface of the attachment platform, the plurality of support legs contacting the support surface so as to hold the first siding attachment accessory at a distance from the support surface;

a first siding panel including a panel body, a first lock disposed along a first edge of the panel body, a second lock disposed along a second edge of the panel body, and a fastening strip coupled to the first lock, the fastening strip including at least one aperture therethrough; and insulation disposed between the attachment platform of the first siding attachment accessory and the support surface, wherein the support legs of the first siding attachment accessory extend through the insulation, wherein the prongs of each siding hanger of the one or more siding hangers of the first siding attachment accessory extend through an aperture of the fastening strip of the first siding panel so as to secure the first siding panel to the support structure.

18. The siding attachment accessory according to claim 7, wherein the one or more siding hangers includes three siding hangers disposed in a line.

19. The siding attachment accessory according to claim 7, wherein the attachment platform includes an aperture configured to receive a mechanical fastener for securing the siding attachment accessory to a support surface.

20. A building surface siding system comprising:

a support structure;

a first siding attachment accessory attached to the support structure, the first siding attachment accessory comprising an attachment platform including a front face and a rear face; and a first siding hanger, a second hiding hanger, and a third siding hanger disposed in a line, each of the first siding hanger, the second hiding hanger, and the third siding hanger extending forward from the front face of the attachment platform and including a retaining arm having a proximal end attached to the front face of the attachment platform and a distal end spaced from the attachment platform, the retaining arm including a pair of prongs that are configured to snap into an aperture in the siding component; and a first siding panel including a panel body, a first lock disposed along a first edge of the panel body, a second lock disposed along a second edge of the panel body, and a fastening strip coupled to the first lock, the fastening strip including at least one aperture therethrough, wherein the prongs of each siding hanger of the three siding hangers of the first siding attachment accessory extend through an aperture of the fastening strip of the first siding panel so as to secure the first siding panel to the support structure.

* * * * *